US005206119A

United States Patent [19]

Kuse et al.

[11] Patent Number: 5,206,119

[45] Date of Patent: Apr. 27, 1993

[54] METHOD OF PROCESSING LIGHT-SENSITIVE SILVER HALIDE COLOR PHOTOGRAPHIC MATERIAL, AND STABILIZING SOLUTION AND STABILIZING AGENT KIT USED FOR SAID LIGHT-SENSITIVE MATERIAL

[75] Inventors: Satoru Kuse; Shigeharu Koboshi; Masayuki Kurematsu; Masao Ishikawa, all of Hino, Japan

[73] Assignee: Konica Corporation, Tokyo, Japan

[21] Appl. No.: 908,775

[22] Filed: Jul. 1, 1992

Related U.S. Application Data

[63] Continuation of Ser. No. 616,702, Nov. 20, 1990, abandoned, which is a continuation of Ser. No. 393,592, Aug. 14, 1989, abandoned.

[30] Foreign Application Priority Data

Aug. 19, 1988 [JP] Japan ..... 63-205900
Aug. 24, 1988 [JP] Japan ..... 63-210976

[51] Int. Cl.[5] ..... G03C 11/00

[52] U.S. Cl. ..... 430/372; 430/428; 430/430; 430/432; 430/963; 430/463; 430/491; 430/611

[58] Field of Search ..... 430/428, 430, 432, 372, 430/963, 463, 491, 611

[56] References Cited

U.S. PATENT DOCUMENTS 3,271,153 9/1966 Miller et al. ..... 430/428
3,271,156 9/1966 Miller et al. ..... 430/428
3,335,004 8/1967 Wrisley et al. ..... 430/372
4,537,856 8/1985 Kurematsu et al. ..... 430/432
4,912,026 3/1990 Miyoshi et al. ..... 430/551
4,980,272 12/1990 Kuse et al. ..... 430/372

FOREIGN PATENT DOCUMENTS 0071402 2/1983 European Pat. Off. ..... 430/428
196661A 8/1987 Japan ..... 430/428

*Primary Examiner*—Charles L. Bowers, Jr.
*Assistant Examiner*—Thomas R. Neville
*Attorney, Agent, or Firm*—Frishauf, Holtz, Goodman & Woodward

[57] ABSTRACT

Disclosed is a method of processing a light-sensitive silver halide color photographic material subjected to imagewise exposure, substantially through a color developing step, a bleach-fixing step and a stabilizing step in this order, wherein at least one layer of the light-sensitive silver halide color photographic material comprises a silver halide containing not less than 80 mol % of silver chloride, the washing-substitutive stabilizing step is carried out in a processing time of not more than 45 seconds, and a washing-substitutive stabilizing solution used in the washing-substitutive stabilizing step has a salt concentration of at least 1,000 ppm. Disclosed are also a washing-substitutive stabilizing solution and a kit of a stabilizer used for the method of this invention. According to this invention, processing of a light-sensitive material that have better prevented the bluing at exposed areas of color photographic papers and also have suppressed the generation of mildew or bacteria on a processed light-sensitive material, moreover that have been improved in paper jam and the like due to incompleteness of drying and also can conduct rapid processing is enabled.

22 Claims, 5 Drawing Sheets

METHOD OF PROCESSING LIGHT-SENSITIVE SILVER HALIDE COLOR PHOTOGRAPHIC MATERIAL, AND STABILIZING SOLUTION AND STABILIZING AGENT KIT USED FOR SAID LIGHT-SENSITIVE MATERIAL

This application is a continuation of application Ser. No. 07/616,702, filed Nov. 10, 1990, which is a continuation of application Ser. No. 07/393,592 filed Aug. 14, 1989.

BACKGROUND OF THE INVENTION

This invention relates to a method of processing a light-sensitive silver halide color photographic material (hereinafter, referred to "light-sensitive material") and a stabilizing solution. More particularly, it relates to a method of processing a light-sensitive material and a stabilizing solution that have better prevented the bluing at exposed areas of color photographic papers and also have suppressed the generation of mildew or bacteria on a processed light-sensitive material, moreover that have been improved in paper jam and the like due to incompleteness of drying and also can conduct rapid processing.

This invention further relates to a stabilizing solution and a stabilizing agent kit which are used for the light-sensitive silver halide color photographic material. More particularly, it relates to a stabilizing solution and a stabilizing agent kit, used in a single-tank stabilizing step, that have been improved in carrying performance in automatic processing machines for ultra-rapid processing.

In general, in the processing of light-sensitive materials having been imagewise exposed to light to obtain color images, a color developing step is followed by processing steps of desilvering metallic silver formed, and thereafter washing and stabilizing or washing-substitutive stabilizing.

Such development processing in color photography has been hitherto carried out in a large quantity and centralized processing system by collecting negative films in a large-scale photofinishing laboratories. This, however, causes an increase in collection and delivery cost and also requires a much longer processing time.

On the other hand, the development processing has come to require no piping for supplying and discharging washing water because of actual utilization of non-washing processing that uses no washing water. This has made it possible to carry out development processing of color photography any place having an electric source available. Moreover, the technique to make rapid the development processing has brought about a rapid progress of the scattering of processing as a result of the advent of so-called minilabs or microlabs, and it has become possible that exposed films can be processed while one waits.

Further, it has become possible to introduce the color photographic development processing into office machines such as color copying machines and video printers.

However, recently, further rapid processing has been strongly demanded. Particularly, in order to compete with a still video system, the silver salts photographic system which can conduct processing easily in home or storefront has been desired.

In such circumstance, Eastman Kodak Co. proposed on 1986 a rapid processing of color photographic papers, called Process RA-4, which is carried out with a processing time of 3 minutes, a processing temperature of 35° C., where the processing time is detailed to comprise three steps of color developing for 45 seconds, bleach-fixing for 45 seconds and stabilizing for 90 seconds.

This system is an epoch making system in which the feature resides in using higher silver chloride emulsion to shorten the color developing time and bleach-fixing time to ½ to 1/5 as compared with conventional systems. However, it was found that this system has the following problems.

Namely, rapid processing tend to generate mildew or bacteria on the processed light-sensitive materials, to cause troubles of bluing at the exposed area on color papers, and further to cause paper jam in drying sections due to the conditions of processing circumstance of color papers.

Particularly, in the case where the processing is carried out for a shorter time than in RA-4, the above troubles tend to occur significantly.

SUMMARY OF THE INVENTION

As a result of extensive studies in view of the above problems, the present inventors found that there is close relationship between the above problems and the composition of silver halides, salts concentration in the stabilizing solution and processing time of the stabilizing solution. The reason why the mildew and bacteria tend to generate is considered as follows. Mildewproofing agents or bactericides are also usually contained in stabilizing solutions so that mildew or microrganisms can be suppressed from generating on the stabilizing solutions themselves and processed light-sensitive materials. However, when the rapid processing as mentioned above is carried out, the mildewproofing agents or bactericides remain in light-sensitive materials in a lessened amount because of a short contact time between light-sensitive materials and stabilizing solutions, to cause the disadvantage that the fungi or bacteria tend to generate on the processed light-sensitive materials. In particular, more severe circumstances are brought about when the processing time is shorter than that in the above Process RA-4.

The reason why the above problems are alleviated by increasing the salt concentration in the stabilizing solution is presumed to be the effect due to the residual salts in the light-sensitive material and the effect "pushing" of the mildewproofing agent into the light-sensitive material.

Also, the reason why the bluing is alleviated is presumed that a dyeing affinity or dyeability of the brightening agent in the color developing solution to silver is changed depending on the composition of silver halide; in the stabilizing solution, for example, the brightening agent in the stabilizing solution is not sufficiently dyed to the light-sensitive material by shortening the stabilizing processing time; or the scattering of the brightening agent into the light-sensitive material by increasing the salt concentration.

Moreover, the paper jam in the drying section (hereinafter, referred to "jam trouble") is presumed to be caused by, for example in the case of high humidity, increase of water loading in the light-sensitive material, but it is also presumed that the jam troubles are alleviated by the fact that low water loading can stably maintained by increasing the salt concentration regardless of the processing circumstances such as humidity.

In despite of the above assumptions, it was the totally unexpected fact for the present inventors that the mildewproofing performance of the light-sensitive material, bluing and jam troubles are alleviated by using higher silver chloride emulsion as a silver halide, increasing the salt concentration in the stabilizing solution and further conduct the process for less than 45 seconds.

Accordingly, an object of this invention is to provide a method of processing a light-sensitive material which can produce stable photographic images and photographic properties when rapid processing is carried out and further have less jam troubles. The second object is to provide a method of processing a light-sensitive material which is competitive with also electrophotographic system.

The present inventors have extensively made studies for accomplishing the above objects and found that these objects can be accomplished by a method of processing a light-sensitive silver halide color photographic material subjected to imagewise exposure, substantially through a color developing step, a bleach-fixing step and a stabilizing step in this order, wherein at least one layer of said light-sensitive silver halide color photographic material comprises a silver halide containing not less than 80 mol % of silver chloride, said stabilizing step is carried out in a processing time of not more than 45 seconds, and a stabilizing solution used in said stabilizing step has a salt concentration of at least 1,000 ppm.

As the preferred embodiment, the stabilizing solution used in the stabilizing step further contains at least one metal salt selected from the group consisting of Ca, Mg, Ba, Al, Zn, Ni, Bi, Sn and Zr.

The present inventors found, as a stabilizing solution usable for the above method of this invention, a stabilizing solution for a light-sensitive silver halide color photographic material, used in a stabilizing step carried out substantially after a color developing step and a bleach-fixing step, wherein at least one layer of said light-sensitive silver halide color photographic material comprises a silver halide containing not less than 80 mol % of silver chloride, said stabilizing step is carried out in a processing time of not more than 45 seconds, and a stabilizing solution used in said stabilizing step has a salt concentration of at least 1,000 ppm.

Further, the present inventors a kit comprising a stabilizer for stabilizing solution which is used for stabilizing step by use of one bath, which comprises at least one metal salt selected from the group consisting of Ca, Mg, Ba, Al, Zn, Ni, Bi, Sn and Zr and a description instructing to use the stabilizing solution for not more than 45 seconds subsequent to a color developing step and a bleach-fixing step.

DESCRIPTION OF THE PREFERRED EMBODIMENTS

Figure 1:
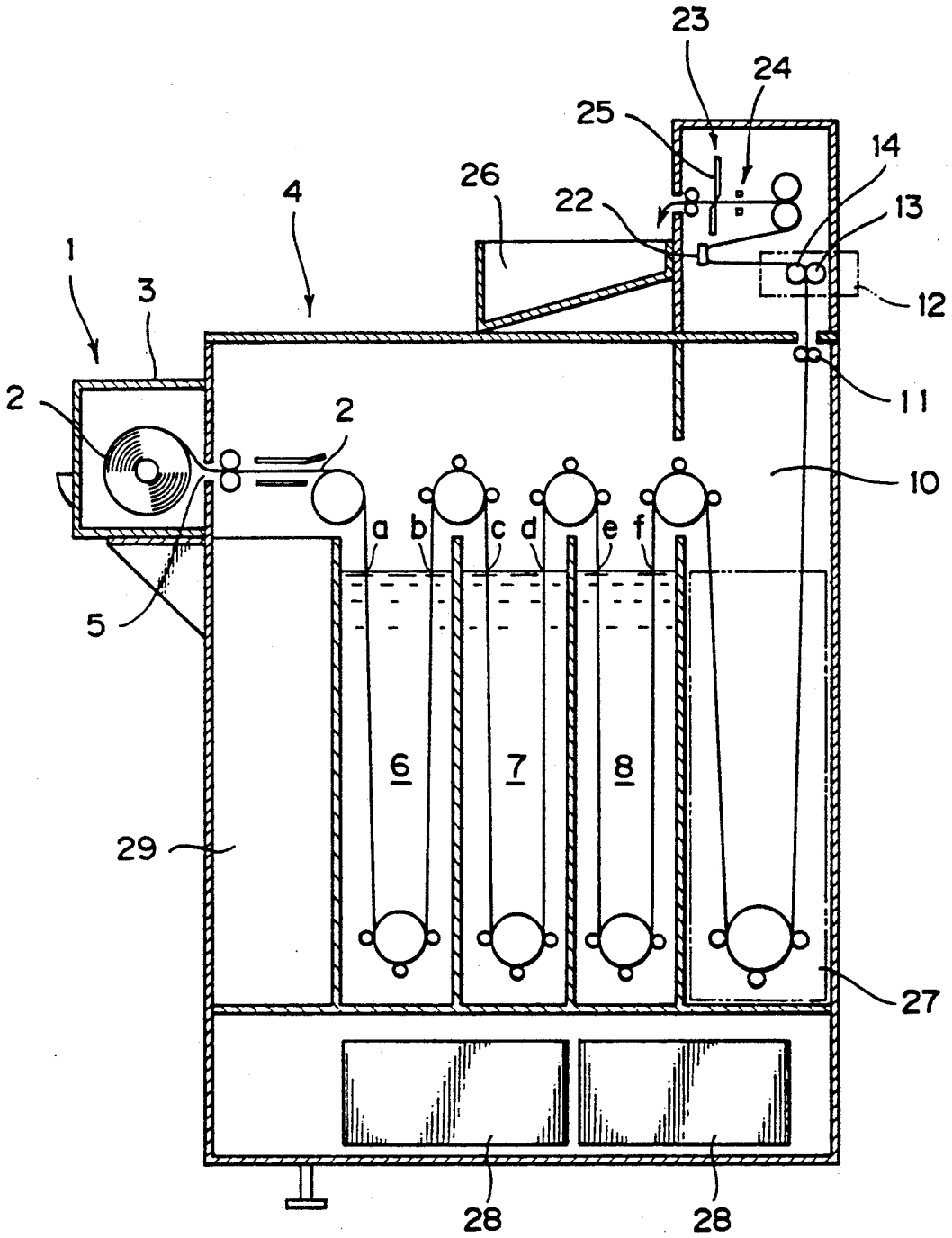
FIG. 1 shows an example of an automatic processing apparatus for photographic papers according to this invention.

In the present invention, the processing time for color developing refers to the time after a light-sensitive material is brought into contact with a color developing solution and before the corresponding same part thereof is brought into contact with a bleach-fixing solution. The processing time for bleach-fixing refers to the time after a light-sensitive material is brought into contact with a bleach-fixing solution and before the corresponding same part thereof is brought into contact with a stabilizing solution. The processing time for stabilizing also refers to the time after a light-sensitive material is brought into contact with a stabilizing solution and immediately before the corresponding same part thereof is carried in the step of drying.

Hereinafter, this invention will be described below in detail.

As a related technique, though different from this invention, a method is known in which processing is carried out using a final washing bath having a salt concentration of not less than 500 ppm, thereby decreasing the amount of washing water and better preventing deterioration of the film quality of color photographic papers, as disclosed in Japanese Unexamined Patent Publication No. 196661/1987. As will be seen from Examples therein, however, this technique comprises a stabilizing step (called "washing step" in Japanese Unexamined Patent Publication No. 196661/1987) carried out in a processing time of from 90 seconds to 3 minutes, which is a relatively long time, and also has different objects and effects. Thus, this differs from this invention in its basic technical idea.

A preferred embodiment of stabilizing processing will be described below. Hereinbelow, the stabilizing processing used in this invention refers to a washing-substitutive stabilizing processing, unless otherwise specified. The washing-substitutive stabilizing processing will be apparent from the following description.

Compounds preferably used in the stabilizing solution of this invention include chelating agents having a chelate stability constant to iron ions, of not less than 8. These are preferably used for making ferric complex component in the bleach-fixing solution colorless to obtain stable photographic properties, improving the image maintaining property after processing and further obtaining the effect to mildew and bacteria.

The chelate stability constant herein mentioned refers to the constant commonly known from L. G. Sillen and A. E. Martell, "Stability Constants of Metal-ion Complexes", The Chemical Society, London (1964), S. Chaberek and A. E. Martell, "Organic Sequestering Agents", Wiley (1959).

The chelating agents having a chelate stability constant to iron ions, of not less than 8, preferably used in the stabilizing solution, include organic carboxylic acid chelating agents, organic phosphoric acid chelating agents, inorganic phosphoric acid chelating agents, and polyhydroxy compounds. The iron ions mentioned above refer to ferric ions ($Fe^{3+}$).

Examples of specific compounds of the chelating agents having a chelate stability constant to ferric ions, of not less than 8 include the following, but are by no means limited to these. That is to say, they include ethylenediaminediorthohydroxyphenylacetic acid, diaminopropanetetraacetic acid, nitrilotriacetic acid, hydroxyethylethylenediaminetriacetic acid, hydroxyethylglycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, transcyclohexanediaminetetraacetic acid, glycol ether diaminetetraacetic acid, ethylenediaminetetrakismethylenephosphonic acid, nitrilotrismethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-diphosphonic acid, sodium pyrophosphate, sodium tetrapolyphosphate, sodium hexamethaphosphate, hydroxyaminodiphosphonylmethane, diethylenetriaminepentamethylenephosphonic acid, tripolyphosphoric acid. They particularly preferably include diethylenetriaminepentaacetic acid, nitrilotriacetic acid, nitrilotrimethylenephosphonic acid, and 1-hydroxyethylidene-1,1-diphosphonic acid, among which most preferably used is 1-hydroxyethylidene-1,1-diphosphonic acid.

The above chelating agent may be used in an amount preferably from 0.01 to 50 g, and more preferably from 0.05 to 20 g, per liter of the stabilizing solution.

Compounds further added in the stabilizing solution include ammonia compounds as particularly preferred compounds, because it is effective in improving in image lasting property and mildewproofing property after processing and against bluing.

These are supplied by ammonium salts of various sorts of inorganic compounds, which specifically include ammonium hydroxide, ammonium bromide, ammonium carbonate, ammonium chloride, ammonium sulfate, and ammonium acetate.

In this invention, a stabilizing solution having been subjected to ion exchange treatment may also be used.

The pH of the stabilizing solution applicable in this invention may preferably range between 4.0 and 10.0, preferably 4.5 to 9.0. The pH adjustors that can be contained in the washing-substitutive stabilizing agent applicable in this invention may be any of alkali agents or acid agents commonly known in the art.

The stabilizing processing may be carried out at a temperature ranging between 15° C. and 80° C., preferably 20° C. and 60° C. The processing time therefor is within 45 seconds in this invention. If the processing time is longer than 45 seconds, the effect of this invention cannot be obtained, and particularly badly affect bluing. Preferable processing time is from 3 seconds to 35 seconds, and most preferably from 5 seconds to 25 seconds. The effect of this invention can significantly be exhibited in short time processing.

In this invention, the salt concentration in the stabilizing solution is required to be at least 1,000 ppm, but may preferably be in the range of from 2,000 ppm to 50,000 ppm, more preferably in the range of from 3,000 ppm to 30,000 ppm, and most preferably from 4,000 ppm to 15,000 ppm.

The intended salt concentration of this invention may be achieved by adding the above various additives in the stabilizing solution, or may be made to originate from the components of a bleach-fixing solution, adhered to a light-sensitive material and carried in from the anterior bath bleach-fixing solution.

Metal salts used in this invention, selected from Ca, Mg, Ba, Al, Zn, Ni, Bi, Sn and Zr, can be supplied in the form of inorganic salts such as halides, hydroxides, sulfates, carbonates, nitrates and phosphates, organic salts such as acetates, citrates and salicylates, or water-soluble chelating agents. They may preferably be used in an amount ranging from $1\times10^{-4}$ to 1 mol, and more preferably from $1\times10^{-3}$ to $3\times10^{-1}$ mol, per liter of the stabilizing solution. In a preferred method, the above metal salts may be used in combination of two or more kinds.

The use of metal salts in this invention can alleviate jam trouble and is further effective in white background of the unexposed portion and image lasting performance, and thus preferably used.

The stabilizing solution of this invention may preferably contain a mildewproofing agent. Mildewproofing agents preferably used include hydroxybenzoate compounds, phenol compounds, thiazole compounds, pyridine compounds, guanidine compounds, carbamate compounds, morpholine compounds, quaternary phosphonium compounds, ammonium compounds, urea compounds, isoxazole compounds, propanolamine compounds, sulfamide compounds, amino acid compounds, active halogen releasing compounds, and benztriazole compounds.

The above hydroxybenzoate compounds include methyl ester, ethyl ester, propyl ester and butyl ester of hydroxybenzoic acid, but preferably include n-butyl ester, isobutyl ester and propyl ester of hydroxybenzoic acid. More preferably they include a mixture of the above three esters of hydroxybenzoic acid.

The phenol compounds preferably used as mildewproofing agents are compounds that may have an alkyl group, a halogen atom, a nitro group, a hydroxyl group, a carboxylic acid group, an amino group, a phenyl group or the like as a substituent, and preferably include orthophenylphenol, orthocyclohexiphenol, phenol, nitrophenol, chlorophenol, cresol, guaiacol, and aminophenol. Particularly preferably, orthophenylphenol is preferably used in this invention.

The thiazole compounds are compounds having a nitrogen atom or sulfur atom in a ring of 5-members, and preferably include 1,2-benzisothiazolin-3-one, 2-methyl-4-isothiazolin-3-one, 2-octyl-4-isothiazolin-3-one, 5-chloro-2-methyl-4-isothiazolin-3-one, and 2-chloro-4-thiazolylbenzimidazole.

The pyridine compounds specifically include 2,6-dimethylpyridine, 2,4,6-trimethylpyridine, and sodium-2-pyridinethiol-1-oxide, but preferably include sodium-2-pyridinethiol-1-oxide.

The guanidine compounds specifically include cyclohexidine, polyhexamethylenebiguanidine hydrochloride, and dodecylguanidine hydrochloride, but preferably include dodecylguanidine and salts thereof.

The carbamate compounds specifically include methyl-1-(butylcarbamoyl)-2-benzimidazole carbamate and methylimidazole carbamate.

The morpholine compounds specifically include 4-(2-nitrobutyl)morpholine and 4-(3-nitrobutyl)morpholine.

The quaternary phosphonium compounds include tetraalkyl phosphonium salts and tetraalkoxy phosphonium salts, but preferably include tetraalkyl phosphonium salts. More preferred specific compounds are tri-n-butyl-tetradecylphosphonium chloride and triphenyl.nitrophenylphosphonium chloride.

The quaternary ammonium compounds specifically include benzalkonium salts, benzethonium salts, tetraalkylammonium salts, and alkylpyridinium salts, and more specifically include dodecyldimethylbenzylammonium chloride, dodecyldimethylammonium chloride and laurylpyridinium chloride.

The urea compounds specifically include N-(3,4-dichlorophenyl)-N'-(4-chlorophenyl)urea and N-(3-trifluoromethyl)-N'-(4-chlorophenyl)urea.

The isoxazole compounds specifically include 3-hydroxy-5-methyl-isoxazole.

The propanolamine compounds include n-propanols and isopropanols, specifically including DL-2-benzylamino-1-propanol, 3-diethylamino-1-propanol, 2-dimethylamino-2-methyl-1-propanol, 3-amino-1-propanol, isopropanolamine, diisopropanolamine, and N,N-dimethyl-isopropanolamine.

The sulfamide compounds include o-nitrobenzenesulfamide, p-aminobenzenesulfamide, 4-chloro-3,5-dinitrobenzenesulfamide, and α-amino-p-toluenesulfamide.

The amino acid compounds specifically include N-lauryl-β-alanine.

The benztriazole compound specifically include the following:

(a) Benztriazole (b)

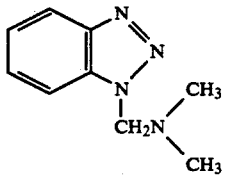

(c)

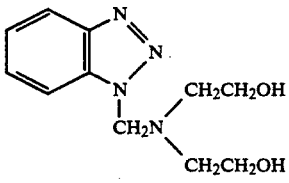

(d)

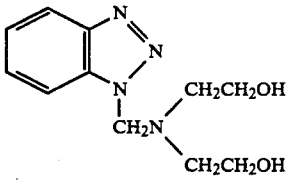

(e)

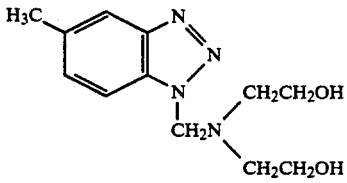

(f)

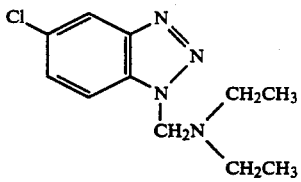

(g)

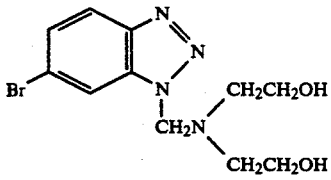

Further, useful as the mildew proofing agents are also hyposulfite compounds or hyposulfite compound releasing compounds.

Of the above mildewproofing agents, the compounds preferably used in this invention are phenol compounds, thiazole compounds, pyridine compounds, guanidine compounds, quaternary ammonium compounds, hyposulfite compounds, and benztriazole compounds. Particularly preferred from the viewpoint of solution shelf stability are phenol compounds, thiazole compounds, hyposulfite releasing compounds, and benztrizole compounds.

An amount less than 0.001 g, of the mildewproofing agent added per liter of the stabilizing solution can not bring about the effect of stabilizing dye images, and also an amount more than 50 g may bring about an unfavorable result in cost. Thus, to further improve the storage stability of dye images, the mildewproofing agent is used in an amount ranging from 0.001 to 50 g, and preferably ranging from 0.005 to 10 g.

The sulfites to be incorporated in the stabilizing solution of this invention may include any of inorganic substances, organic substances, etc., so far as they can release sulfite ion. Preferred are iorganic salts which are preferably specified by sodium sulfite, potassium sulfite, ammonium sulfite, ammonium bisulfite, potassium bisulfite, sodium bisulfite, sodium metabisulfite, potassium metabisulfite, ammonium metabisulfite and hydrosulfite, sodium cartharaldehyde bisbisulfite, sodium succinic aldehyde bisbisulfite, etc.

The above sulfite should preferably be added in the washing-substitutive stabilizing solution so that the amount of the sulfite may be at least $1.0\times10^{-3}$ mol/lit., more preferably $5\times10^{-3}$ to $1.0\times10^{-1}$ mol/lit. The sulfite may be added directly to the washing-substitutive solution, but preferably to a replenisher of the washing-substitutive stabilizing solution.

As a method for supplying the stabilizing replenisher in the stabilizing processing step, there may be included, in the instance where multi-tank counter current system is employed, a method in which the solution is suppled to the posterior bath and overflowed to the anterior bath, or in the instance where single tank is employed, processing is made by providing ion exchange resins or electrodialysis. However, in practicing this invention, preferred is to process by using two or less bathes, particularly preferred is one tank in view of preventing the jam troubles and accomplishing rapidity.

The amount of the stabilizing replenisher in the stabilizing step of this invention is preferably 0.1 to 50 times, particularly preferably 0.5 to 30 times, of the amount carried from the anterior bath (bleach-fixing solution) per a unit area of the light-sensitive material.

Into the color developing solution used for the color developing processing step, instead of the hydroxylamine conventionally used as a preservative, preferably used are organic preservatives such as hydroxylamine derivaitves, hydroxamic acids, hydrazines, hydrazides, phenols, α-hydroxyketones, α-aminoketones, saccharides, monoamines, diamines, quaternary ammonium salts, nitroxy radicals, alcohols, oximes, diamide compounds, fused ring type amines, etc. as described in Japanese Unexamined Patent Publication Nos. 146043/1988, 146042/1988, 146041/1988, 146040/1988, 135938/1988, 118748/1988 and 62639/1989.

In the instance where the compound represented by Formula (I) is incorporated as more preferable embodiment of this invention, rapid processing can be accomplished, bluing is alleviated, crystal precipitation on the liquid surface of the color developing solution bath is improved, and another effect can be revealed.

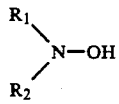

Formula (I)

s

In the formula, $R_1$ and $R_2$ each represent an alkyl group or a hydrogen atom, provided that both $R_1$ and $R_2$ are not hydrogen atoms at the same time. $R_1$ and $R_2$ may also form a ring.

In Formula (I), $R_1$ and $R_2$ each represent an alkyl group or a hydrogen atom, which are not hydrogen atoms at the same time. The alkyl group represented by $R_1$ and $R_2$ may be the same or different, and each preferably represent an alkyl group having 1 to 3 carbon atoms. The alkyl groups of $R_1$ and $R_2$ may include those having a substituent, and also $R_1$ and $R_2$ may be combined to form a ring. It may form, for example, a heterocyclic ring such as piperidine or morpholine.

Specific compounds of the hydroxylamine series compounds represented by Formula (I) are described in U.S. Pat. No. 3,287,125, No. 3,293,034 and No. 3,287,124. Preferred specific exemplary compounds are shown below.

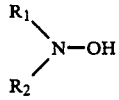

| Exemplary compound No. | $R_1$ | $R_2$ |
|---|---|---|
| A-1 | $-C_2H_5$ | $-C_2H_5$ |
| A-2 | $-CH_3$ | $-CH_3$ |
| A-3 | $-C_3H_7(n)$ | $-C_3H_7(n)$ |
| A-4 | $-C_3H_7(i)$ | $-C_3H_7(i)$ |
| A-5 | $-CH_3$ | $-C_2H_5$ |
| A-6 | $-C_2H_5$ | $-C_3H_7(i)$ |
| A-7 | $-CH_3$ | $-C_3H_7(i)$ |
| A-8 | $-H$ | $-C_2H_5$ |
| A-9 | $-H$ | $-C_3H_7(n)$ |
| A-10 | $-H$ | $-CH_3$ |
| A-11 | $-H$ | $-C_3H_7(i)$ |
| A-12 | $-C_2H_5$ | $-C_2H_4OCH_3$ |
| A-13 | $-C_2H_4OH$ | $-C_2H_4OH$ |
| A-14 | $-C_2H_4SO_3H$ | $-C_2H_5$ |
| A-15 | $-C_2H_4COOH$ | $-C_2H_4COOH$ |
| A-16 | 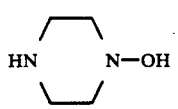 | |
| A-17 | 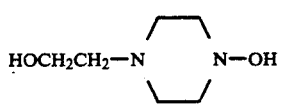 | |
| A-18 | 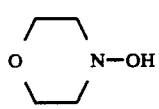 | |
| A-19 | 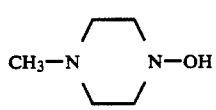 | |
| A-20 | $-CH_3$ | $-C_2H_4OCH_3$ |
| A-21 | $-C_2H_4OCH_3$ | $-C_2H_4OCH_3$ |
| A-22 | $-C_2H_4OC_2H_5$ | $-C_2H_4OC_2H_5$ |
| A-23 | $-C_3H_6OCH_3$ | $-C_3H_6OCH_3$ |

-continued

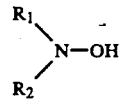

| Exemplary compound No. | $R_1$ | $R_2$ |
|---|---|---|
| A-24 | $-C_2H_5$ | $-C_2H_4OC_2H_5$ |
| A-25 | $-C_3H_7$ | $-C_2H_4OCH_3$ |
| A-26 | $-CH_3$ | $-C_2H_4OC_2H_5$ |
| A-27 | $-CH_3$ | $-CH_2OCH_3$ |
| A-28 | $-C_2H_5$ | $-CH_2OC_2H_5$ |
| A-29 | $-CH_2OCH_3$ | $-CH_2OCH_3$ |
| A-30 | $-C_2H_5$ | $-C_2H_4OC_3H_7$ |
| A-31 | $-C_3H_6OC_3H_7$ | $-C_3H_6OC_3H_7$ |
| A-32 | 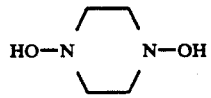 | |

These compounds are used usually in the form of free amine, hydrochloride, sulfate, p-toluene sulfonate, oxalate, phosphate, acetate, and so forth.

The compound represented by Formula (I) of this invention is used in the color developing solution in a concentration of usually from 0.2 g/lit. to 50 g/lit., preferably from 0.5 g/lit. to 30 g/lit., and more preferably from 1 g/lit. to 15 g/lit.

In this color developing solution, hydroxylamine, conventionally used, can also be used together with the compound represented by Formula (I) and the above-mentioned organic preservative. However, the hydroxylamine is preferably not used in view of developability.

An improvement effect can also be exhibited with respect to air oxidation of color developing solutions and also substantially no bad effect is caused even if incorporated into the bleach-fixing solution, when a compound represented by the following Formula (II) is contained in the color developing solution according to this invention. Thus, the compound may preferably be used.

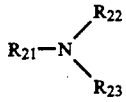

Formula (II)

In the formula, $R_{21}$ represents a hydroxyalkyl group having 2 to 6 carbon atoms; and $R_{22}$ and $R_{23}$ each represent a hydrogen atom, an alkyl group having 1 to 6 carbon atoms, a hydroxyalkyl group having 2 to 6 carbon atoms, a benzyl group, or a group of the formula:

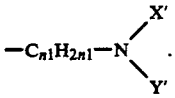

In the above formula, n1 represents an integer of 1 to 6; and X' and Y' each represent a hydrogen atom, an alkyl group having 1 to 6 carbon atoms, or a hydroxyalkyl group having 2 to 6 carbon atoms.

Preferred examples of the compound represented by the above Formula (II) are as follows.

(II-1) Ethanolamine (II-2) Diethanolamine (II-3) Triethanolamine
(II-4) Di-isopropanolamine
(II-5) 2-Methylaminoethanol
(II-6) 2-Ethylaminoethanol
(II-7) 2-Dimethylaminoethanol
(II-8) 2-Diethylaminoethanol
(II-9) 1-Diethylamino-2-propanol
(II-10) 3-Diethylamino-1-propanol
(II-11) 3-Dimethylamino-1-propanol
(II-12) Isopropylaminoethanol
(II-13) 3-Amino-1-propanol
(II-14) 2-Amino-2-methyl-1,3-propanediol
(II-15) Ethylenediaminetetraisopropanol
(II-16) Benzylethanolamine
(II-17) 2-Amino-2-(hydroxymethyl)-1,3-propanediol On account of the effect as aimed in this invention, these compounds represented by the above Formula (II) may preferably be used in the range of from 1 g to 100 g per liter of the color developing solution, and may more preferably be used in the range of from 2 g to 30 g.

The color developing solution used in this invention preferably has a sulfite concentration of $4\times10^{-2}$ mol or less, more preferably $2\times10^{-4}$ to 0 mol per one liter of the color developing solution with respect to the rapidness and bleach-fixibility. This is because that, when the sulfite concentration in the color developing solution is high, silver chloride-rich emulsion more tend to receive the effect as compared with the silver bromide rich-containing emulsion which has been conventionally used and cause reduction of concentration to a great extent.

As the sulfites which may be used in this invention, there may be exemplified sodium sulfite, potassium sulfite, sodium bisulfite, potassium bisulfite, etc.

As a color developing agent used in this invention, preferably used is a p-phenylenediamine compound having a water soluble group.

In a p-phenylenediamine compound as a color developing agent used in this invention, having a water soluble group, at least one water soluble group is present on the amino group or benzene nucleus of the p-phenylenediamine compound. Specific water-soluble groups may preferably includes;

$-(CH_2)_n-CH_2OH$;
$-(CH_2)_m-NHSO_2-(CH_2)_n-CH_3$;
$(CH_2)_m-O-(CH_2)_n-CH_3$;
$(CH_2CH_2O)_nC_mH_{2m+1}$; (m and n each represent an integer of 0 or more), a —COOH group, and $-SO_3H$ group)

Specific exemplary compounds of the p-phenylenediamine compound as a color developing agent preferably used in this invention are shown below.

(A-1)

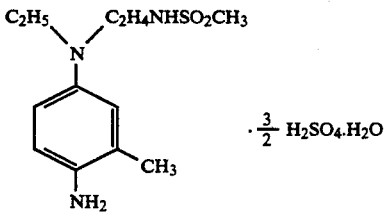

-continued (A-2)

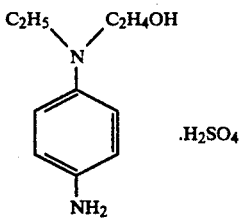

(A-3)

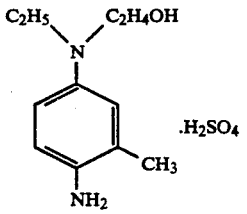

(A-4)

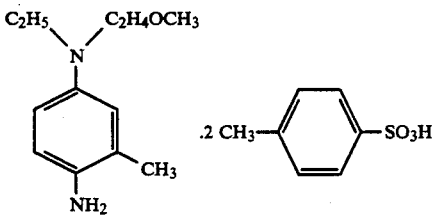

(A-5)

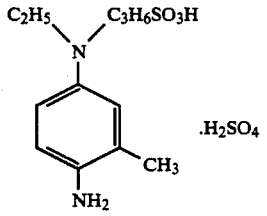

(A-6)

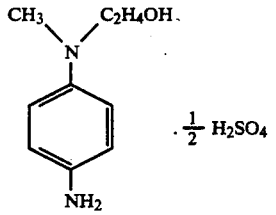

(A-7)

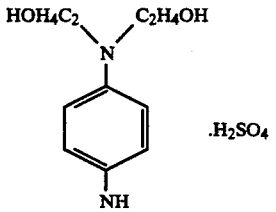

(A-8)

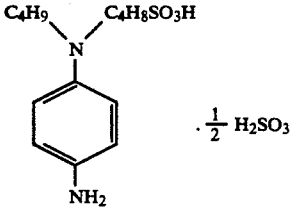

-continued

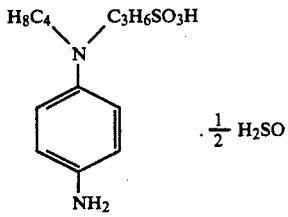

(A-9)

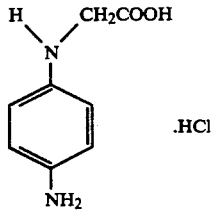

(A-10)

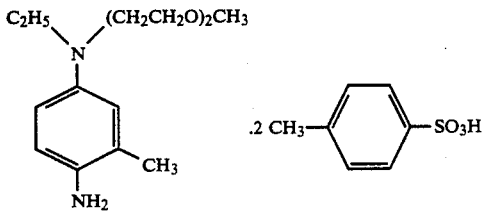

(A-11)

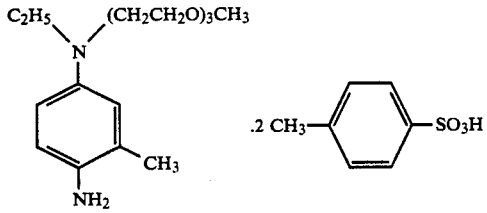

(A-12)

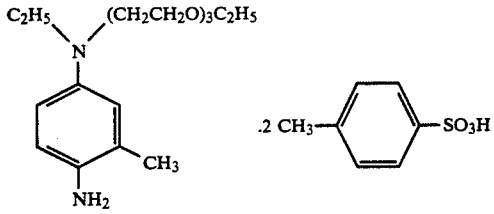

(A-13)

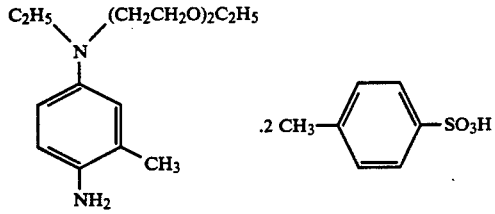

(A-14)

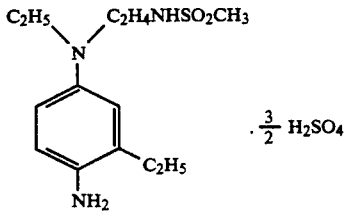

(A-15)

-continued

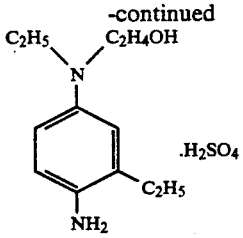

(A-16)

Of the color developing agents exemplified in the above, preferably usable in this invention are the compounds indicated as Exemplary Nos. (A-1), (A-2), (A-3), (A-4), (A-6), (A-7) and (A-15). Particularly preferred is the compound No. (A-1).

The above color developing agents are used usually in the form of a salt such as a hydrochloride, a sulfate or a p-toluenesulfonate.

The p-phenylenediamine series compound used in this invention, having the water-soluble group, must be used in an amount of not less than $1.5\times10^{-2}$ mol, preferably in the range of from $2.0\times10^{-2}$ mol to $1.0\times10^{-1}$ mol, and more preferably in the range of from $2.5\times10^{-2}$ mol to $7.0\times10^{-2}$ mol, per liter of the color developing solution.

The color developing solution of this invention may contain the following developing solution components in addition to the above components.

Alkali agents as exemplified by sodium hydroxide, potassium hydroxide, silicate, sodium metaborate, potassium metaborate, trisodium phosphate, tripotassium phosphate, and borax can be used alone, or can be used in combination so long as no precipitation may be generated and the effect of stabilizing the pH can be maintained. Because of the necessity in view of preparation, or for the purpose of enhancing ionic strength, salts can be used which include disodium hydrogenphosphate, dipotassium hydrogenphosphate, sodium bicarbonate, potassium bicarbonate, and borates.

It is also possible to optionally add an inorganic or organic antifoggant.

It still also possible to optionally use a development accelerator. The development accelerator includes all sorts of pyridinium compounds as typified in U.S. Pat. No. 2,648,604 and No. 3,671,247, and Japanese Patent Publication No. 9503/1969, and other cationic compounds, cationic dyes such as phenosafranine, or neutral salts such as thallium nitrate; polyethylene glycol and derivatives thereof as disclosed in U.S. Pat. No. 2,533,990, No. 2,531,832, No. 2,950,970 and No. 2,577,172, and Japanese Patent Publication No. 9504/1969; nonionic compounds such as polythioether. It also includes phenethyl alcohol as disclosed in U.S. Pat. No. 2,304,925, as well as acetylene glycol, methyl ethyl ketone, cyclohexanone, thioethers, pyridine, ammonia, hydrazine, and amines.

It is not preferred in this invention to use benzyl alcohol. Bad-soluble organic solvents as typified by the above phenethyl alcohol may also preferably be not used for the reasons of efficiently achieving the above objects of this invention. Its use, when accompanied with the use of the color developing solution over a long period of time, tends to cause generation of tar particularly in running processing according to a low-replenishing system. Such generation of tar results in its sticking to paper light-sensitive material to be processed, even bringing about a serious trouble that its commercial value is greatly damaged.

The bad-soluble organic solvents have so a poor solubility to water that not only they may require troublesomeness such that they require a stirring device in preparing the stabilizing solution itself, but also they may have a limit to the effect of accelerating development, because of its poorness in solubility, even if such a stirring device is used.

In addition, the bad-soluble organic solvents may give a large environmental load value such as biochemical oxygen demand (BOD). Hence, they have the problems that a spent solution can not be thrown into a drainage or river, and treatment of the spent solution requires much labor and cost. Thus, not only benzyl alcohol but also other bad-soluble organic solvents should preferably be used in an amount as little as possible or be not used.

In the color developing solution of this invention, it is also possible to optionally use ethylene glycol, methyl cellosolve, methanol, acetone, dimethylformamide, β-cyclodextrin, and other compounds as disclosed in Japanese Patent Publications No. 33378/1972 and No. 9509/1969, as organic solvents for increasing the solubility of developing agents.

It is further possible to use auxiliary developing agents together with developing agents. These auxiliary developing agents include, for example, N-methyl-p-aminophenol hexasulfate (Metol), phenidone, N,N'-diethyl-p-aminophenol hydrochloride, and N,N,N',N'-tetramethyl-p-phenylenediamine hydrochloride, which are known in the art. These may preferably be added in an amount of usually from 0.01 g to 1.0 g per liter.

It is still further possible to additionally use various additives such as anti-stain agents, anti-sludge agents and multi-layer effect accelerators.

All sorts of chelating agents may also be added in the color developing solution of this invention. There may be added, for example, diethylenetriaminepentaacetic acid, ethylenediaminetetraacetic acid, nitrilotriacetic acid, ethylenediaminetetramethylenephosphonic acid, tripolyphosphoric acid, hexametaphosphoric acid, and 1-hydroxyethylidene-1,1-diphosphonic acid.

The color developing solution can be prepared by adding the above components successively in given water followed by stirring. On this occasion, a component having a low solubility to water can be added by mixing it with the above organic solvent or the like such as triethanol amine. In more common instances, a preparation previously prepared in a small container by bringing a plurality of components capable of stably coexisting with each other, into a state of an aqueous concentrated solution or a solid may be added in water followed by stirring. The preparation can be thus obtained as the color developing solution of this invention.

In this invention, the above color developing solution can be used in any pH range, but may preferably be used at a pH of from 9.5 to 13.0, and more preferably a pH of from 9.8 to 12.0, from the viewpoint of the rapid processing.

In this invention, various processing systems can also be used, including a monobath processing system, and other various systems as exemplified by a spray system in which processing solutions are formed into spray, a web system that utilizes contact with a carrier impregnated with processing solutions, and a development system that employs viscous processing solutions. However, the processing steps substantially comprise the steps of color developing, bleach-fixing and stabilizing.

In this invention, the bleach-fixing step is provided after the processing step of color developing.

The bleach-fixing solution to be used in this invention will be described below.

The organic acid which forms organic acid ferric complex salts such as aminopolycarboxylic acid is preferably aminopolycarboxylic acid series compounds and aminophosphonic acid series compounds, which each represent an amino compound having at least one carboxylic acid group and an amino compound having at least one or more phosphonic acid group, preferably the compounds represented by Formulas (III) and (IV) shown below.

Fomrula (III):

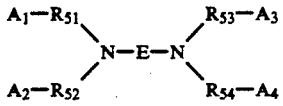

Formula (IV):

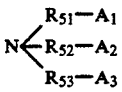

wherein, E represents a substituted or unsubstituted alkylene group, cycloalkylene group, phenylene group, $—R_{55}OR_{55}R_{55}—$ or $—R_{55}ZR_{55}—$; Z represents $<N—R_{55}—A_5$ or $<N—A_5$; $R_{51}$ to $R_{55}$ each represent a substituted or unsubstituted alkylene group; $A_1$ to $A_5$ each represent —OH, —COOM and $—PO_3M_2$; and M represents a hydrogen atom or an alkali metal atom.

Specific examples of the compounds represented by Formulas (III) and (IV) may include the following:

[III-1] Ethylenediaminetetraacetic acid
[III-2] Diethylenetriaminepentaacetic acid
[III-3] Ethylenediamine-N-(β-hydroxyethyl)-N,N',N'-triacetic acid
[III-4] 1,3-Propylenediaminetetraacetic acid
[III-5] Triethylenetetraminehexaacitic acid
[III-6] Cyclohexanediaminetetraacetic acid
[III-7] 1,2-Diaminopropanetetraacetic acid
[III-8] 1,3-Diaminopropane-2-ol-2-tetraacetic acid
[III-9] Ethyl ether diaminetetraacetic acid
[III-10] Glycol ether diaminetetraacetic acid
[III-11] Ethylenediaminetetrapropionic acid
[III-12] Phenylenediaminetetraacetic acid
[III-13] Disodium ethylenediaminetetraacetate
[III-14] Tetra(trimethyl)ammonium ethylenediaminetetraacetate
[III-15] Tetrasodium ethylenediaminetetraacetate
[III-16] Pentasodium diethylenetriaminepentaacetate
[III-17] Sodium ethylenediamine-N-(β-oxyethyl)-N,N',N'-triacetate
[III-18] Sodium propylenediaminetetraacetate
[III-19] Ethylenediaminetetramethylenephosphonic acid
[III-20] Sodium cyclohexanediaminetetraacetate
[IV-1] Nitrilotriacetic acid
[IV-2] Iminodiacetic acid
[IV-3] Hydroxyethyliminodiacetic acid
[IV-4] Nitrilotripropionic acid
[IV-5] Nitrilotrimethylenephosphonic acid
[IV-6] Iminodimethylenephosphonic acid
[IV-7] Hydroxyethyliminodimethylenphosphonic acid

[IV-8] Trisodium nitrilotriacetate

Of the aminocarboxylic acid series compounds and aminophosphonic acid series compounds, preferably usable in this invention in respect of the effect of this invention are (III-1), (III-2), (III-4), (III-5), (III-6), (III-7), (III-8), (III-10), (III-19), (IV-1), (IV-3) and (IV-5).

Among the above aminocarboxylic acid series compounds and aminophosphonic acid series compounds, particularly preferred are (III-1), (III-2), (III-4) and (III-8) in viewpoint of high bleach-fixing ability and rapidness.

The ferric complex salts of the above compounds may be used in one kind, but may be used in combination of two or more thereof.

These bleaching agent may be used preferably in an amount of 5 to 450 g/lit., and more preferably 20 to 250 g/lit., but in viewpoint of rapidness and effects against incompleteness of drying and bluing, preferably in an amount of 80 g/lit. or more, and more preferably 100 to 250 g/lit.

The bleach-fixing solution may contain a silver halide fixing agent in addition to the bleaching agent mentioned above, and, if necessary, a solution having the composition containing sulfite as a preservative may be used. There can be also used a special bleach-fixing solution having the composition to which an ethylenediaminetetraacetic acid iron (III) complex salt bleaching agent and a large quantity of a halide such as ammonium bromide are added. Besides ammonium bromide, the above halide that can be used may include hydrochloric acid, hydrobromic acid, lithium bromide, sodium bromide, potassium bromide, sodium iodide, potassium iodide, and ammonium iodide.

The silver halide fixing agent contained in the bleach-fixing solution typically includes the compounds capable of forming a water soluble complex salt by reacting with a silver halide, as used in ordinary fixing processing, for example, thiosulfates such as potassium thiosulfate, sodium thiosulfate and ammonium thiosulfate; thiocyanates such as potassium thiocyanate, sodium thiocyanate and ammonium thiocyanate; thioureas; and thioethers. Preferably effective are ammonium salts which are high in diffusing speed to the gelatin layer. These fixing agents may be used in an amount of 5 g/lit. or more and in the range of the amount that can be dissolved. In general, they may be used in an amount of 70 g to 250 g/lit., preferably 100 g/lit. to 250 g/lit. in viewpoint of rapidness.

The bleach-fixing solution may contain, solely or in combination, a variety of pH buffering agents such as boric acid, borax, sodium hydroxide, potassium hydroxide, sodium carbonate, potassium carbonate, sodium bicarbonate, potassium bicarbonate, acetic acid, sodium acetate and ammonium hydroxide. It may also contain various brightening agents, anti-foaming agents or surface active agents. It may further appropriately contain preservatives such as bisulfite addition products of hydroxylamine, hydrazine or an aldehyde compound, organic chelating agents such as aminopolycarboxylic acid or stabilizers such as nitroalcohol and nitrate, and organic solvents such as methanol, dimethylsulfonamide and dimethylsulfoxide.

In the bleach-fixing solution used in this invention, various bleach accelerating agents may be added, which are disclosed in Japanese Unexamined Patent Publication No. 280/1971, Japanese Patent Publications No. 8506/1970, and No. 556/1971, Belgian Patent No. 770,910, Japanese Patent Publications No. 8836/1970 and No. 9854/1978, Japanese Unexamined Patent Publications No. 71634/1979 and No. 2349/1974, etc.

The bleach-fixing solution may be used, in general, at a pH of not less than 4.0 and not more than 9.5, more preferably at a pH of not less than 4.5 and not more than 8.5, and, stated furthermore, most preferably at a pH of not less than 5.0 and not more than 8.0 to carry out the processing. The processing temperature to be used may be a temperature of not more than 80° C., and preferably a temperature of not less than 35° C. not more than 70° C. while suppressing the evaporation or the like. The processing temperature above 70° C. is unfavorable in viewpoint of dryness and the processing temperature below 35° C. is unfavorable in viewpoint of rapidness. The processing time of the bleach-fixing is preferably 2 seconds to 50 seconds, more preferably 3 seconds to 40 seconds, most preferably 5 seconds to 30 seconds. Such short processing time results in preferred effect against the bluing performance as described above.

The processing time in the whole processing steps of the color developing step, bleach-fixing step and stabilizing step in this invention may preferably be within 90 seconds, more preferably from 6 seconds to 75 seconds, particularly preferably from 9 seconds to 60 seconds, and most preferably from 15 seconds to 50 seconds. The effect of this invention, particularly effect against bluing is significantly shown by setting the whole processing time of the whole processing steps within 90 seconds.

Silver halide grains used in the light-sensitive material applied in this invention comprise silver halide particles containing at least not less than 80 mol % of silver chloride, and preferably those containing not less than 90 mol %, more preferably not less than 95 mol %, and most preferably not less than 99 mol %, of silver chloride. Such concentration of silver chloride is effective in rapidness and against bluing, and thus is essential component of this invention.

Silver halide emulsions containing the above silver halide grains may contain silver bromide and/or silver iodide as the composition of silver halides, in addition to the silver chloride. On this occasion, silver bromide may be contained in an amount of not more than 20 mol %, preferably not more than 10 mol %, and more preferably not more than 3 mol %, and, when silver iodide is present, not more than 1 mol %, and preferably not more than 0.5 mol %. Such silver halide particles comprising not less than 80 mol % of silver chloride may be applied in at least one silver halide emulsion layer, but should preferably be applied in all silver halide emulsion layers.

Crystals of the above silver halide grains may be of regular crystals, twin crystals or others, and there can be used those having any ratio of [1.0.0] face to [1.1.1] face. The crystal structure of these silver halide grains may be uniform through inside to outside, or may be of layered structure comprising an inside and outside of different nature (a core/shell type). These silver halide grains may be also of the type such that a latent image is mainly formed on the surface, or of the type wherein it is formed in the inside of a grain. Plate-like silver halide grains (see Japanese Unexamined Patent Publications No. 113934/1983 and No. 47959/1986) can be also used.

The silver halide grains used in this invention may be obtained by any preparation methods including an acidic method, a neutral method and an ammoniacal method.

Alternatively, seed grains may be prepared according to an acidic method, which are allowed to grow according to an ammoniacal method that can achieve higher growth rate, until they grow to have a given size. When making the silver halide grains grow, it is preferred to control the pH, pAg, etc. in a reaction vessel, and pouring and mixing silver ions and halide ions successively and simultaneously in the amount corresponding to the growth rate of silver halide grains as disclosed, for example, in Japanese Unexamined Patent Publication No. 48521/1979.

The silver halide grains according to this invention are preferably prepared in the above manner. In the present specification, a composition containing such silver halide grains are referred to as a silver halide emulsion.

The silver halide emulsion layers used in this invention contain color couplers. These color couplers form nondiffusible dyes upon reaction with oxidized products of color developing agents. Color couplers are advantageously combined in the non-diffusible form, in light-sensitive layers or in a close adjacency thereto.

Thus, a red-sensitive layer can contain, for example, a non-diffusible color coupler that forms a cyan portion color image, which is, in general, a phenol or α-naphthol coupler. A green-sensitive layer can contain, for example, at least one non-diffusible color coupler that forms a magenta portion color image, which is, in usual cases, a 5-pyrazolone color coupler and pyrazolotriazole. A blue-sensitive layer can contain, for example, at least one non-diffusible color coupler that forms a yellow portion color coupler, which is, in general, a color coupler having an open chain ketomethylene group. The color couplers can be 6-, 4- or 2-equivalent couplers.

In this invention, 2-equivalent couplers are particularly preferred.

Suitable couplers are disclosed, for example, in the following publications: W. Pelz, "Farbkuppler", in Mitteilungln ausden Forschungslaboratorien der Agfa, Leverkusen/Munchen, Vol. III. p. 111 (1961); K. Venkataraman, "The Chemistry of Synthetic Dyes", Vol. 4, 341–387, Academic Press; "The Theory of the Photographic Process, Fourth Edition, pp. 353–362; and Research Disclosure No. 17643, Section VII.

In this invention, it is particularly preferred in view of the effect as aimed in this invention to use, in combination with the light-sensitive material of this invention, the magenta coupler represented by Formula (M-1) as described at page 26 of the specification of Japanese Unexamined Patent Publication No. 106655/1988 (specific exemplary magenta couplers of these include No. 1 to No. 77, described at pages 29–34 of the specification of Japanese Unexamined Patent Publication No. 106655/1988), the cyan coupler represented by Formula (C-I) or (C-II) described at page 34 of the same (specific exemplary cyan couplers include (C'-1) to (C'-82) and (C''-1) to (C''-36), described at pages 37–42 of the same specification, and the high speed yellow coupler as described at page 20 of the same (specific exemplary yellow couplers include (Y'-1) to Y'-39), described at pages 21–26 of the same specification. The cyan couplers represented by formula (C-I) and (C-II) from Japanese unexamined Patent Publication No. 106655/1988, shown at page 34 thereof, are as follows:

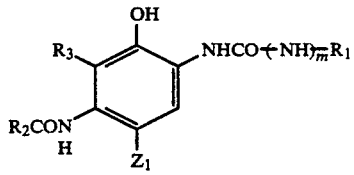

(C-I)

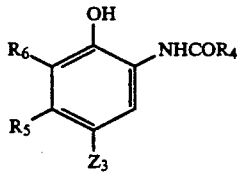

(C-II)

wherein $R_1$, $R_2$ and $R_4$ represents respectively optionally substituted fatty group, aryl group or heterocyclic group, $R_3$ and $R_6$ represents respectively hydrogen, halogen and optionally substituted fatty group, aryl group or acylamino group, $R_2$ and $R_3$ may make a ring, $R_5$ represents an optionally substituted alkyl, $Z_1$ and $Z_2$ represents respectively hydrogen or a group able to split off by the reaction with oxidized color developing agent, n means 0 or 1.

In this invention, in an instance in which nitrogen-containing heterocyclic mercapto compounds are used in combination in the silver chloride-rich light-sensitive material of this invention, not only the effect as aimed in this invention can be exhibited in a good state, but also an additional effect can be achieved such that the photographic performance is very slightly affected when a bleach-fixing solution has been included in a color developing solution. Thus, this can be said to be a more preferred embodiment in this invention.

Specific examples of these nitrogen-containing heterocyclic mercapto compounds include (I'-1) to (I'-87), described at pages 42–45 of the specification of Japanese.

The nitrogen containing heterocyclic mercapto compounds of the formula (I'-I) to (I'-87) are as follows:

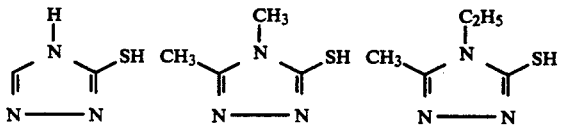

I'-1 I'-2 I'-3

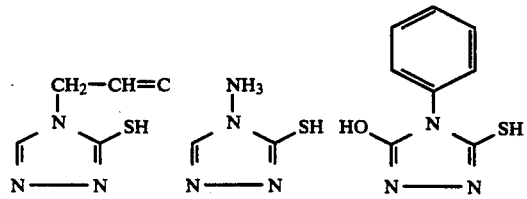

I'-4 I'-5 I'-6

-continued
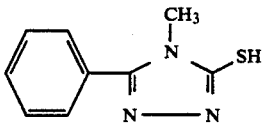
I'-7
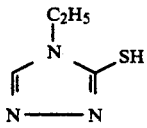
I'-8
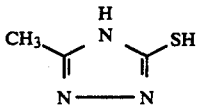
I'-9
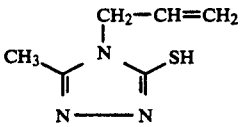
I'-10
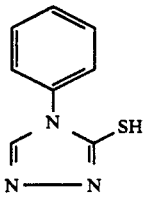
I'-11
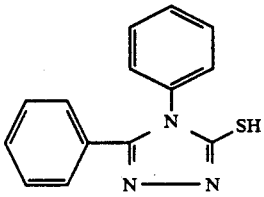
I'-12
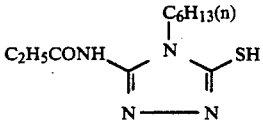
I'-13
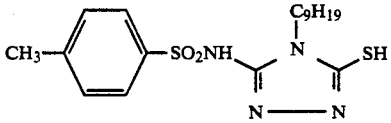
I'-14
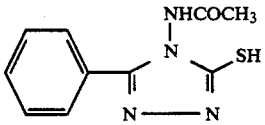
I'-15
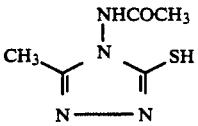
I'-16
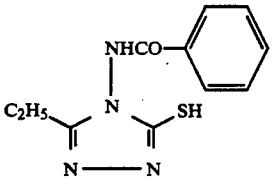
I'-17
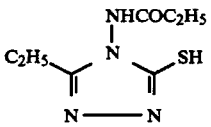
I'-18
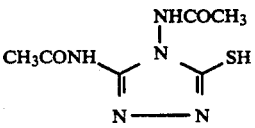
I'-19
-continued
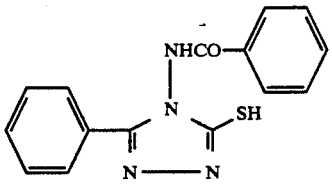
I'-20
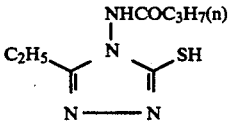
I'-21
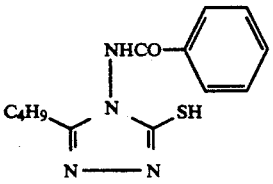
I'-22
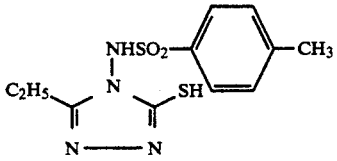
I'-23
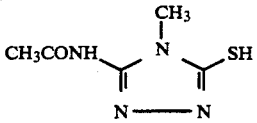
I'-24
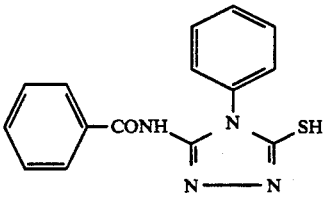
I'-25
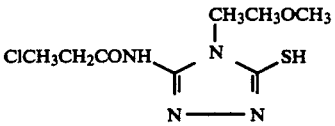
I'-26
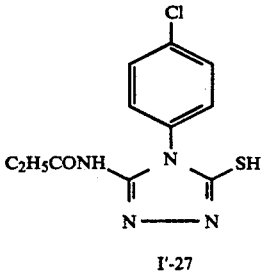
I'-27

-continued
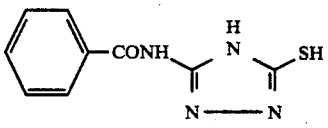
I'-28
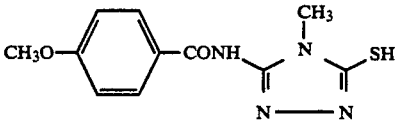
I'-29
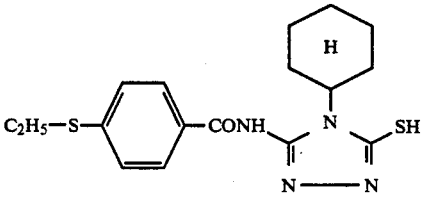
I'-30
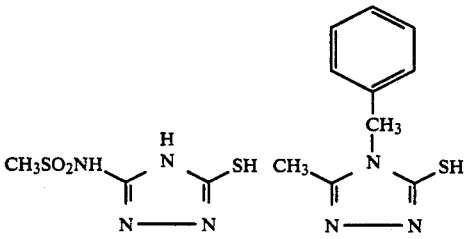
I'-31 I'-32
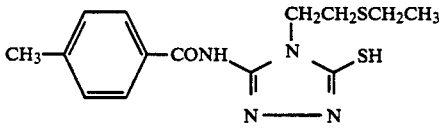
I'-33
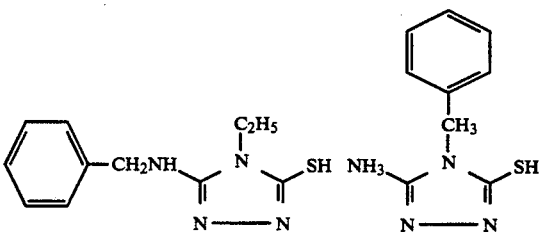
I'-34 I'-35
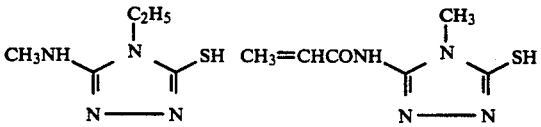
I'-36 I'-37
-continued
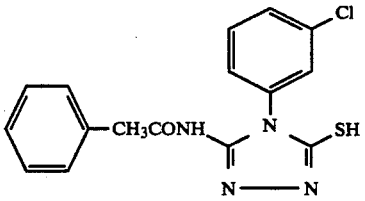
I'-38
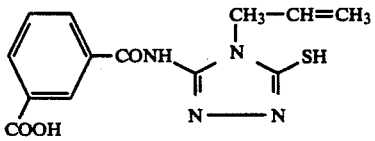
I'-39
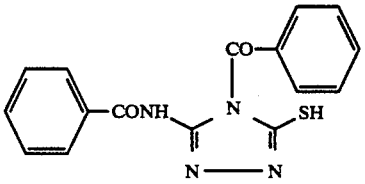
I'-40
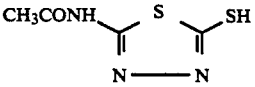
I'-41
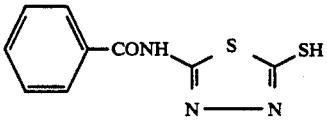
I'-42
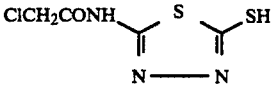
I'-43
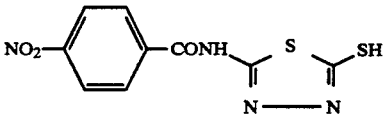
I'-44
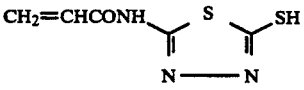
I'-45
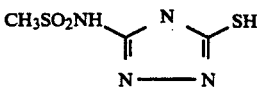
I'-46

-continued
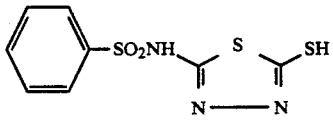
I'-47
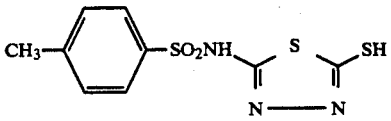
I'-48
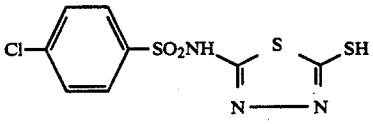
I'-49
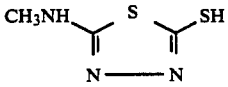
I'-50
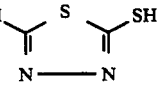
I'-51
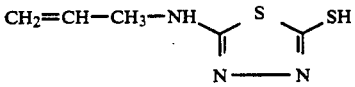
I'-52
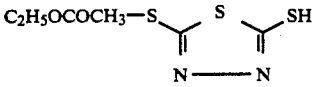
I'-53
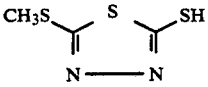
I'-54
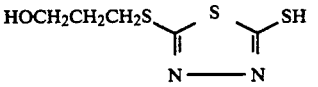
I'-55
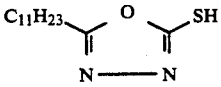
I'-56
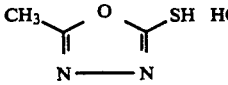
I'-57
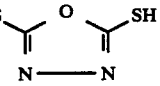
I'-58
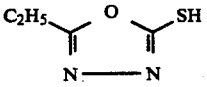
I'-59
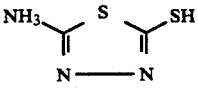
I'-60
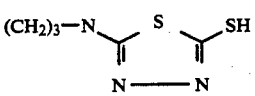
I'-61
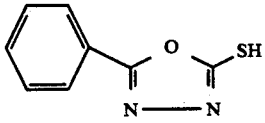
I'-62
-continued
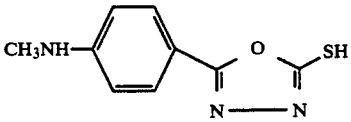
I'-63
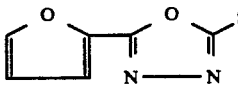
I'-64
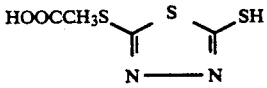
I'-65
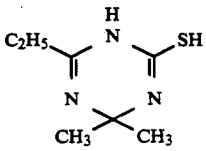
I'-66
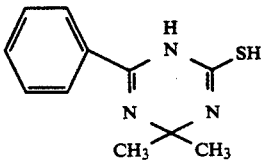
I'-67
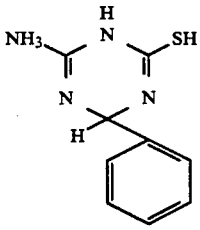
I'-68
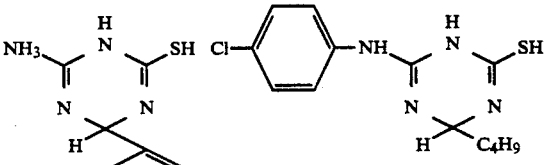
I'-69
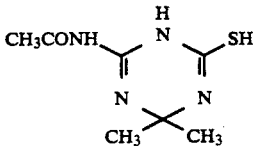
I'-70
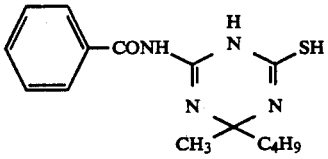
I'-71
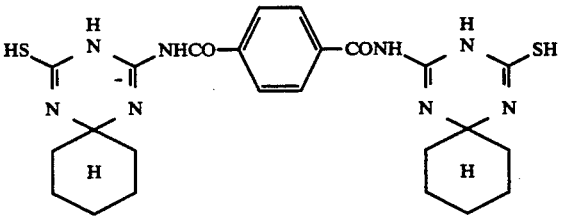
I'-72

-continued

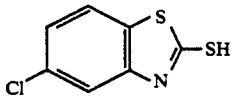

I'-73

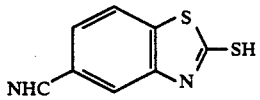

I'-74

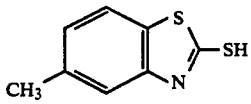

I'-75

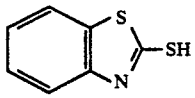

I'-76

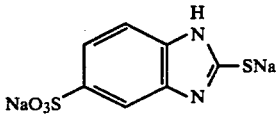

I'-77

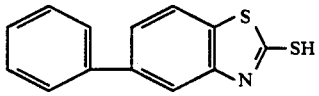

I'-78

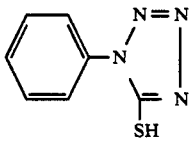

I'-79

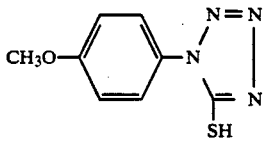

I'-80

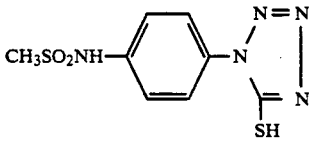

I'-81

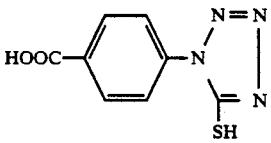

I'-82

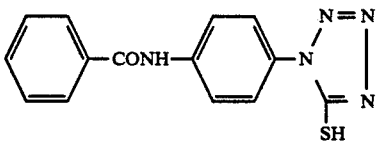

I'-83

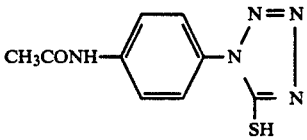

I'-84

-continued

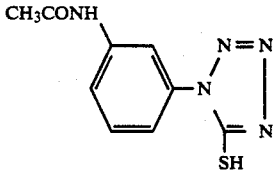

I'-85

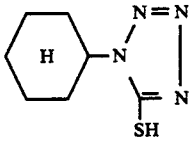

I'-86

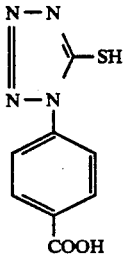

I'-87

The silver halide emulsion having a silver chloride content of not less than 90 mol % in this invention can be prepared by a conventional method (for example, a single flowing or double flowing method in which materials are fed in a constant or accelerating rate). Particularly preferred is a preparation method according to the double flowing method carried out while controlling the pAg; see Research Disclosure No. 17643, Sections I and II.

The emulsions can be chemically sensitized. Particularly preferred are sulfur-containing compounds such as allylisothiocyanate, allylthiourea, and thiosulfate. Reducing agents can also be used as chemical sensitizers, which are silver compounds as disclosed, for example, in Belgian Patents No. 493,464 and No. 568,687, and polyamines such as diethylenetriamine or aminomethylsulfinic acid derivatives as disclosed in, for example, Belgian Patent No. 547,323. A noble metal such as gold, platinum, palladium, iridium, ruthenium or rhodium and a noble metal compound are also suited as sensitizers. This chemical sensitizing method is described in a paper by R. Kosiovsky in Z. Wiss, Photo. 46, 65–72 (1951); see also the above Research Disclosure No. 17643, Section III.

The emulsions can be optically sensitized according to a known method using, for example, ordinary polymethine dyes such as neutrocyanine, a basic or acidic carbocyanine, rhodamine cyanine and hemicyanine, styryl dyes, oxonols, and analogues thereof; see F. M. Hamer, "The Cyanine Dyes and Related Compounds" (1964), Ullmanns Enzyklpadie der Technischen Chemie, Fourth Edition, Vol. 18, p. 431 and the next, and the above Research Disclosure No. 17643, Section IV.

In the emulsions, antifoggants and stabilizers conventionally used can be used. Azaindenes are particularly suitable stabilizers, among which tetra- and pentaazaindenes are preferred, and those which have been substituted with a hydroxyl group or amino group are particularly preferred. The compounds of this type are disclosed, for example, in a paper by Birr, Z. Wiss. Photo. 47, 1952, pp. 2–58, and the above Research Disclosure No. 17643, Section IV.

Components of the light-sensitive material can be incorporated therein according to a conventionally known method; see, for example, U.S. Pat. No.

2,322,027, No. 2,533,514, No. 3,689,271, No. 3,764,336 and No. 3,765,897.

Components of the light-sensitive material, as exemplified by couplers and ultraviolet absorbents, can also be incorporated therein in the form of charged latexes; see German Patent Application Publication No. 25 41 274 and European Patent Application No. 14,921. The components can also be fixed in the light-sensitive material in the form of polymers; see, for example, German Patent Application Publication No. 20 44 992, and U.S. Pat. No. 3,370,952 and No. 4,080,221.

As supports for the light-sensitive material, usual supports can be used, which are exemplified by supports made of a cellulose ester as exemplified by cellulose acetate, and supports made of polyester. Supports made of paper can also be suited. These can be covered with, for example, polyolefins, in particular, polyethylene or polypropylene; see, in this regard, the above Research Disclosure No. 17643, Section VI.

This invention can be applied to any light-sensitive materials such as color papers, color negative films, color positive films, color reversal films for slides, color reversal films for motion pictures, color reversal films for televisions, and reversal color paper, so long as the light-sensitive material is a light-sensitive material to be processed according to the so-called internal development system in which couplers are contained in the light-sensitive material.

According to this invention, it is possible to provide a method of processing a light-sensitive material, having enabled ultra-rapid processing that has never been expected, causing no troubles due to microorganisms such as mildew and bacteria on processed light-sensitive materials even in such ultra-rapid processing, having better prevented the bluing at exposed areas of color photographic papers and further having been improved in paper jam.

According to this invention, it is also possible to provide a single-tank stabilizing solution and a single-tank stabilizing agent kit, enabling rapid processing, and having the effect of achieving a great improvement against jam troubles, and also provide a single-tank stabilizing solution and a single-tank stabilizing agent kit, capable of processing light-sensitive materials without any problems even when a conventional automatic processing machine is modified into a rapid processing type.

This invention will be described below in greater detail by giving Examples. Embodiments for working this invention, however, are by no means limited to these.

EXAMPLE 1

On polyethylene-coated paper supports, the following layers were provided by coating successively from the support side, to prepare light-sensitive materials.

The polyethylene-coated paper used was comprised of a plain paper with a weight of 165 g/m$_2$, the surface of which was provided with a coating layer of 0.035 mm thick, formed by extrusion coating with use of a mixture comprising 200 parts by weight of polyethylene having an average molecular weight of 100,000 and a density of 0.95 and 20 parts by weight of polyethylene having an average molecular weight of 2,000 and a density of 0.80, to which 6.5 % by weight of an anatase type titanium oxide was added, and the back side of which was provided with a coating layer of 0.040 mm formed with use of only polyethylene. Pretreatment using corona discharge was applied on the polyethylene coating surface of the surface of this support, and thereafter the following layers were successively provided by coating.

First layer:

A blue-sensitive silver halide emulsion layer comprising silver chlorobromide emulsion containing 0.5 mol % of silver bromide. The emulsion contains 320 g of gelatin per mol of silver halide, has been sensitized using $2.4\times10^{-4}$ mol of a sensitizing dye (1) having the structure shown below, per mol of silver halide (using isopropyl alcohol as a solvent), contains 200 mg/m$^2$ of 2,5-di-t-butylhydroquinone and $2.3\times10^{-1}$ mol of a yellow coupler (Y-1) having the structure shown below, per mol of silver halide, which are dissolved and dispersed in dibutyl phthalate, and is coated so as to give a silver weight of 260 mg/m$^2$.

Second layer:

A gelatin layer containing 300 mg/m$^2$ of di-t-octylhydroquinone and 200 mg/m$^2$ of a mixture (1:1:1:1) comprising as ultraviolet absorbents 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chloro-benzotriazole and 2-(2'-hydroxy-3'-5'-di-t-butylphenyl)-5-chloro-benzotriazole, which are dissolved and dispersed in dibutyl phthalate, and is coated so as to give 1,800 mg/m$^2$ of gelatin.

Third layer:

A green-sensitive silver halide emulsion layer comprising silver chlorobromide emulsion containing 0.5 mol % of silver bromide. The emulsion contains 390 g of gelatin per mol of silver halide, has been sensitized using $2.3\times10^{-4}$ mol of a sensitizing dye (1) having the structure shown below, per mol of silver halide, contains $1.5\times10^{-1}$ mol of 2,5-di-t-butylhydroquinone and $1.5\times10^{-1}$ mol of a magenta coupler (M-1) having the structure shown below, per mol of silver halide, which are dissolved and dispersed in a solvent comprising dibutyl phthalate and tricresyl phosphate in 2:1, and is coated so as to give a silver weight of 220 mg/m$^2$. As an antioxidant, 2,2,4-trimethyl-6-lauryloxy-7-t-octylchroman was also added in an amount of 0.30 mol per mol of the coupler.

Fourth layer:

A gelatin layer containing 25 mg/m$^2$ of di-t-octylhydroquinone and 400 mg/m$^2$ of a mixture (2:1.5:1.5:2) comprising as ultraviolet absorbents 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5'-chloro-benzotriazole and 2-(2'-hydroxy-3'-5'-di-t-butylphenyl)-5-chloro-benzotriazole, which are dissolved and dispersed in dibutyl phthalate, and is coated so as to give 1,800 mg/m$^2$ of gelatin.

Fifth layer:

A red-sensitive silver halide emulsion layer comprising silver chlorobromide emulsion containing 0.4 mol % of silver bromide. The emulsion contains 420 g of gelatin per mol of silver halide, has been sensitized using $2.2\times10^{-4}$ mol of a sensitizing dye (2) having the structure shown below, per mol of silver halide, contains 160 mg/m$^2$ of 2,5-di-t-butylhydroquinone and $3.5\times10^{-1}$ mol of a cyan coupler (C-1) having the structure shown below, per mol of silver halide, which are dissolved and dispersed in dibutyl phthalate, and is coated so as to give a silver weight of 260 mg/m$^2$.

Sixth layer:

A gelatin layer, coated so as to give 900 mg/m$^2$ of gelatin.

The silver halide emulsions used in the respective light-sensitive emulsion layers (the first, third and fifth layers) were prepared following the procedures as described in Japanese Patent Publication No. 7772/1971, and were each chemically sensitized using sodium thiosulfate pentahydrate and incorporated with 4-hydroxy-6-methyl-1,3,3a,7-tetrazaindene (2.5 g per mol of silver halide) as a stabilizer, bis (vinylsulfonylmethyl)ether (12 mg per 1 g of gelatin) as a hardening agent, and saponin as a coating aid.

Sensitizing agent (I)

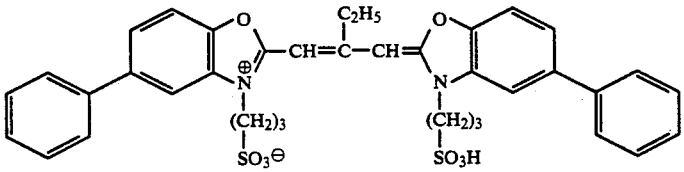

Sensitizing agent (II)

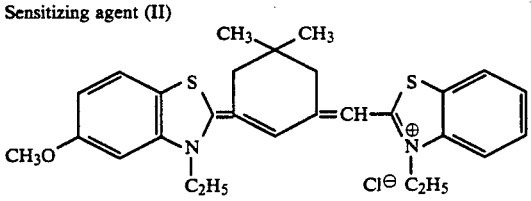

(Y-1)

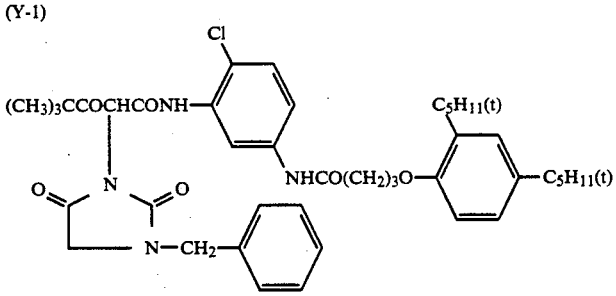

(M-1)

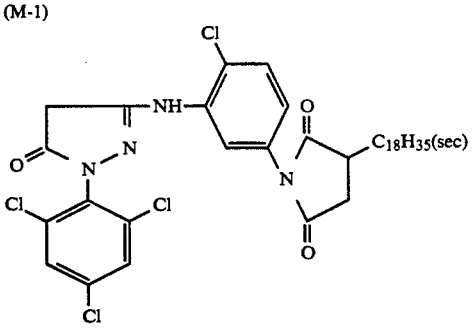

(C-1)

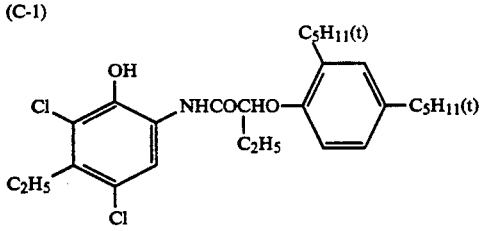

The color photographic papers prepared according to the above procedures were exposed to light, followed by processing using the following processing steps and processing solutions.

| Processing step (1 tank for each) | | Processing time |
|---|---|---|
| (1) Color developing | 38° C. | 20 sec |
| (2) Bleach-fixing | 35° C. | 20 sec |
| (3) Stabilizing | 35° C. | As shown in Table 1 |
| (4) Drying | 60° C. to 80° C. | 30 sec |

(Color developing tank solution)

| | |
|---|---|
| Diethylene glycol | 15 g |
| Potassium bromide | 0.01 g |
| Potassium chloride | 2.3 g |
| Potassium sulfite (a 50% solution) | 0.5 ml |
| Color developing agent (3-methyl-4-amino-N-ethyl-N-(β-methanesulfonamidoethyl)-aniline sulfate | 6.0 g |
| Diethylhydroxylamine (85%) | 5.0 g |
| Triethanolamine | 10.0 g |

-continued

| | |
|---|---|
| Potassium carbonate | 30 g |
| Sodium ethylenediaminetetraacetate | 2.0 g |
| Brightening agent (Kaycoll PK-Conc; available from Nippon Soda Co., Ltd.) | 2.0 g |
| Made up to 1 liter by the addition of water, and adjusted to pH 10.15 using potassium hydroxide or sulfuric acid. | |
| (Color developing replenishing solution) | |
| Diethylene glycol | 17 g |
| Potassium chloride | 3.0 g |
| Potassium sulfite (a 50% solution) | 1.5 ml |
| Color developing agent (3-methyl-4-amino-N-ethyl-N-(β-methanesulfonamidoethyl)-aniline sulfate | 8.8 g |
| Diethylhydroxylamine (85%) | 7.0 g |
| Triethanolamine | 10.0 g |
| Potassium carbonate | 30 g |
| Sodium ethylenediaminetetraacetate | 2.0 g |
| Brightening agent (Kaycoll PK-Conc; available from Nippon Soda Co., Ltd.) | 2.5 g |
| Made up to 1 liter by the addition of water, and adjusted to pH 10.40 using potassium hydroxide or sulfuric acid. | |
| (Bleach-fixing tank solution and replenishing solution) | |
| Ammonium ferric ethylenediaminetetraacetate | 65.0 g |
| Ethylenediaminetetraacetic acid | 3.0 g |
| Ammonium thiosulfate (a 70% solution) | 100.0 ml |
| 5-Amino-1,3,4-thiadiazole-2-thiol | 0.5 g |
| Ammonium sulfite (a 40% solution) | 27.5 ml |
| Adjusted to pH 6.50 using ammonia water or glacial acetic acid, and also made up to 1 liter in total by the addition of water. | |
| (Stabilizing tank solution and replenishing solution) | |
| 5-Chloro-2-methyl-4-isothiazolin-3-one | 0.02 g |
| 2-Methyl-4-isothiazolin-3-one | 0.01 g |
| Cinopearl SFP (available from Ciba Geigy Corp.) | 0.3 g |
| Trisodium nitrilotriacetate | 1.5 g |
| Made up to 1 liter with water, and adjusted to pH 7.5 using ammonia water and 50% sulfuric acid. | |

Into the above stabilizing solution, the above bleach-fixing solution was appropriately mixed so that the stabilizing solution may be adjusted to have a salt concentration as shown in Table 1 below. Mildew that grows on films, cultured on a agar culture medium, was placed on the surfaces of the color photographic papers respectively processed, which were stored in a thermohygrostat kept at 30° C. and a humidity of 90%. These were taken out every week, and the state of generation of mildew was observed. The bluing at the exposed areas was further visually observed. Results obtained are shown together in Table 1.

TABLE 1

| Test No. | Stabilizing solution: Processing time (sec) | Stabilizing solution: Salt concentration (ppm) | Generation of mildew | Occurrence of bluing | Remark |
|---|---|---|---|---|---|
| 1-1 | 180 | 10,000 | 0 to 1 | CC | Comp. |
| 1-2 | 90 | 10,000 | 0 to 1 | C | Comp. |
| 1-3 | 70 | 10,000 | 0 to 1 | C | Comp. |
| 1-4 | 55 | 10,000 | 0 to 1 | C | Comp. |
| 1-5 | 45 | 10,000 | 0 to 1 | B | Inv. |
| 1-6 | 35 | 10,000 | 0 | A | Inv. |
| 1-7 | 25 | 10,000 | 0 | A | Inv. |
| 1-8 | 20 | 10,000 | 0 | A | Inv. |
| 1-9 | 10 | 10,000 | 0 | A | Inv. |
| 1-10 | 5 | 10,000 | 0 to 1 | A | Inv. |
| 1-11 | 3 | 10,000 | 1 | A | Inv. |
| 1-12 | 20 | 500 | 3 | C | Comp. |
| 1-13 | 20 | 800 | 2 | C | Comp. |
| 1-14 | 20 | 1,000 | 1 | B | Inv. |
| 1-15 | 20 | 2,000 | 1 | A | Inv. |
| 1-16 | 20 | 3,000 | 0 to 1 | A | Inv. |
| 1-17 | 20 | 4,000 | 0 | A | Inv. |
| 1-18 | 20 | 6,000 | 0 | A | Inv. |
| 1-19 | 20 | 10,000 | 0 | A | Inv. |
| 1-20 | 20 | 15,000 | 0 | A | Inv. |
| 1-21 | 20 | 20,000 | 0 | A | Inv. |
| 1-22 | 20 | 30,000 | 0 | A | Inv. |
| 1-23 | 20 | 50,000 | 0 | B | Inv. |

In the above table, the mark "A" indicates that no bluing was observed; the mark "B", bluing was a little observed; and the mark "C", bluing was observed to the extent that the product value may be lowered. The more the mark "C" is, the greater the bluing extent is meant to be.

The numerals 0 to 3 in the table also indicate the following meanings.

0: No mildew was observed to have generated on color photographic papers.

1: Mildew was observed to have a little generated on color photographic papers.

2: Mildew was observed to have generated on color photographic papers, to the extent that the areas on which the mildew generated do not exceed ⅓ of the whole area.

3: Mildew was observed to have generated on color photographic papers, to the extent that the areas on which the mildew generated exceed ⅓ of the whole area.

The above Table 1 tells that less mildew generates on the processed color photographic papers, also with good results, when the stabilizing step is carried out under rapid processing of not more than 45 seconds and the salt concentration of the stabilizing solution used therein is not less than 1,000 ppm.

EXAMPLE 2

The same tests as in Test No. 1-8 of Example 1 was repeated except that the silver chlorobromide emulsion used in the first, second and third layers of the color paper prepared in Example 1 were each replaced with the emulsion composition shown in Table 2, to observe how is the occurrence of bluing. Results obtained are shown in Table 2.

TABLE 2

| Test No. | Silver chloride content (mol %) | Occurrence of bluing | Remarks |
|---|---|---|---|
| 2-1 | 60 | C | Comparative |
| 2-2 | 70 | C | Comparative |
| 2-3 | 80 | B | This inv. |
| 2-4 | 90 | A | This inv |
| 2-5 | 95 | A | This inv |
| 2-6 | 99 | A | This inv. |
| 2-7 | 99.5 | A | This inv. |
| 2-8 | 100 | A | This inv. |

In the table, the marks "A", "B" and "C" have the same meanings as Table 1.

It was found from Table 2 that the effect as aimed in this invention was exhibited (better prevention of bluing) when the silver chloride content is not less than 80 mol %.

EXAMPLE 3

The same tests as Example 1 were repeated except that 0.12 mg/m$^2$ of Exemplary Compounds (I'-24), (I'-41), (I'-60), (I'-66), (I'-79) and (I'-84), which are heterocyclic mercapto compounds described in Japanese Unexamined Patent Publication No. 106655/1988, were each added to the respective emulsion layers of the color photographic paper samples used in the tests in Example 1. As a result, in all samples, the density of yellow stain at unexposed area was improved by about 10%. Generation of mildew was also better prevented by about ⅓ in all samples, which is the effect as aimed in this invention.

The same tests as in Example 1 were repeated except that the cyan coupler (C-1) in the color photographic paper samples used in the tests in Example 1 was respectively replaced with the cyan couplers (C'-2), (C'-27), (C'-32), (C'-33), (C'-34), (C'-36), (C'-37), (C'-38), (C'-39), (C'-53), (C''-2), (C''-8) and (C''-9), described at pages 34–42 of the specification of Japanese Unexamined Patent Publication No. 106655/1985. As a result, it was found that the cyan stain was improved by 20 to 30 % and also the occurrence of bluing was better prevented.

EXAMPLE 5

The same tests as Example 1 were repeated except that the diethylhydroxylamine in the color developing solution used in the tests in Example 1 was respectively replaced with the same molar number of Exemplary Compounds A-13, A-18, A-21 and A-7 of the hydroxylamine derivative [the compound represented by Formula (I)]. As a result, there were obtained substantially the same results as Example 1. Similarly the diethylhydroxylamine was replaced with the same molar number of hydroxylamine sulfate. As a result, however, the bluing became serious.

EXAMPLE 6

Using the color photographic papers and processing solutions prepared in Example 1, running processing was carried out.

The running processing was carried out by filling an automatic processing machine with the above color developing tank solution and also with the bleach-fixing tank solution and stabilizing tank solution, and processing the above color photographic papers while replenishing the solutions at intervals of 3 minutes by using the above color developing replenishing solution, bleach-fixing replenishing solution and stabilizing replenishing solution through constant flow pumps.

The replenishing to the color developing tank was made in an amount of 180 ml per 1 $m^2$ of the color photographic paper; the replenishing to the bleach-fixing tank, in an amount of 200 ml of the bleach-fixing replenishing solution per 1 $m^2$ of the color photographic paper; and the replenishing to the stabilizing tank, in an amount of 200 ml of the stabilizing replenishing solution per 1 $m^2$ of the color photographic paper.

The processing of stabilizing, however, was carried out in a processing time of 15 seconds. The running processing was continuously carried out until the quantity of the stabilizing replenishing solution supplied in the stabilizing tank solution came to 3 times the capacity of the stabilizing tank. At the time the running processing was completed, the stabilizing tank had a salt concentration of 17,000 ppm.

The states of generation of mildew and occurrence of bluing on the respective processed color photographic papers were examined in the same manner as Example 1, at the time the running processing was started and at the time it was completed, respectively. As a result, the color photographic papers at the time the running processing was completed were free from both bluing and generation of mildew. On the color photographic papers at the time the running processing was started, however, bluing was observed to have occurred and mildew was also observed to have generated.

EXAMPLE 7

On polyethylene-coated paper supports, the following layers were provided by coating successively from the support side, to prepare light-sensitive materials.

The polyethylene-coated paper used was comprised of a plain paper with a weight of 165 g/$m^2$, the surface of which was provided with a coating layer of 0.035 mm thick, formed by extrusion coating with use of a mixture comprising 200 parts by weight of polyethylene having an average molecular weight of 100,000 and a density of 0.95 and 10 parts by weight of polyethylene having an average molecular weight of 2,000 and a density of 0.80, to which 6.7% by weight of an anatase type titanium oxide was added, and the back side of which was provided with a coating layer of 0.040 mm formed with use of only polyethylene. Pretreatment using corona discharge was applied on the polyethylene coating surface of the surface of this support, and thereafter the following layers were successively provided by coating.

First layer:

A blue-sensitive silver halide emulsion layer comprising silver chlorobromide emulsion containing 0.5 mol % of silver bromide. The emulsion contains 340 g of gelatin per mol of silver halide, has been sensitized using $2.4\times10^{-4}$ mol of the sensitizing dye (1) employed in Example 1, per mol of silver halide (using isopropyl alcohol as a solvent), contains 200 mg/$m^2$ of 2,5-di-t-butylhydroquinone and $2.1\times10^{-1}$ mol of a yellow coupler (Y-1) employed in Example 1, per mol of silver halide, which are dissolved and dispersed in dibutyl phthalate, and is coated so as to give a silver weight of 300 mg/$m^2$.

Second layer:

A gelatin layer containing 310 mg/$m^2$ of di-t-octylhydroquinone and 200 mg/$m^2$ of a mixture (1:1:1:1) comprising as ultraviolet absorbents 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chloro-benzotriazole and 2-(2'-hydroxy-3'- 5'-di-t-butylphenyl)-5-chloro-benzotriazole, which are dissolved and dispersed in dibutyl phthalate, and is coated so as to give 2,000 mg/$m^2$ of gelatin.

Third layer:

A green-sensitive silver halide emulsion layer comprising silver chlorobromide emulsion containing 0.5 mol % of silver bromide. The emulsion contains 460 g of gelatin per mol of silver halide, has been sensitized using $2.5\times10^{-4}$ mol of a sensitizing dye (I) employed in Example 1, per mol of silver halide, contains 2,5-di-t-butylhydroquinone and $1.5\times10^{-1}$ mol of a magenta coupler (M-1) employed in Example 1, per mol of silver halide, which are dissolved and dispersed in a solvent comprising dibutyl phthalate and tricresyl phosphate in 2:1, and is coated so as to give a silver weight of 240 mg/$m^2$. As an antioxidant, 2,2,4-trimethyl-6-lauryloxy-7-t-octylchroman was also added in an amount of 0.30 mol per mol of the coupler.

Fourth layer:

A gelatin layer containing 25 mg/m$^2$ of di-t-octylhydroquinone and 500 mg/m$^2$ of a mixture (2:1.5:1.5:2) comprising as ultraviolet absorbents 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chloro-benzotriazole and 2-(2'-hydroxy-3'-5'-di-t-butylphenyl)-5-chloro-benzotriazole, which are dissolved and dispersed in dibutyl phthalate, and is coated so as to give 2,000 mg/m$^2$ of gelatin.

Fifth layer:

A red-sensitive silver halide emulsion layer comprising silver chlorobromide emulsion containing 0.4 mol % of silver bromide. The emulsion contains 500 g of gelatin per mol of silver halide, has been sensitized using $2.5\times10^{-4}$ mol of a sensitizing dye (2) employed in Example 1, per mol of silver halide, contains 160 mg/m$^2$ of 2,5-di-t-butylhydroquinone and $3.5\times10^{-1}$ mol of a cyan coupler (C-1) employed in Example 1, per mol of silver halide, which are dissolved and dispersed in dibutyl phthalate, and is coated so as to give a silver weight of 290 mg/m$^2$.

Sixth layer:

A gelatin layer, coated so as to give 1,000 mg/m$^2$ of gelatin.

The silver halide emulsions used in the respective light-sensitive emulsion layers (the first, third and fifth layers) were prepared following the procedures as described in Japanese Patent Publication No. 7772/1971, and were each chemically sensitized using sodium thiosulfate pentahydrate and incorporated with 4-hydroxy-6-methyl-1,3,3a,7-tetrazaindene (2.5 g per mol of silver halide) as a stabilizer, bis(vinylsulfonylmethyl)ether (12 mg per 1 g of gelatin) as a hardening agent, and saponin as a coating aid.

The above light-sensitive materials were subjected to stepwise exposure, and then continuous processing for 1 hour with an automatic processing machine, using the following processing steps and the following color developing solution, bleach-fixing solution, and stabilizing solutions (tank solution and replenishing solution) as shown in Table 3. The times that the jam troubles were caused on the color photographic papers in the course of the drying step were measured. Results obtained are shown in Table 4.

| Processing step | Temp. | Time | Amount for replenishing | Number of tank |
|---|---|---|---|---|
| (1) Color developing | 38° C. | 30 sec | ml/m$^2$ | 1 tank |
| (2) Bleach-fixing | 33° C. | 25 sec | 100 ml/m$^2$ | 1 tank |
| (3) Stabilizing | 33° C. | As shown in Table 4 | 500 ml/m$^2$ | As shown in Table 4 *1) |

*1)Double-tank system and triple-tank system were carried out according to countercurrent systems.

Composition of processing solutions:

(Color developing tank solution)

| | |
|---|---|
| Triethanolamine | 10 ml |
| Potassium sulfite | 0.2 g |
| Sodium chloride | 1.5 g |
| Potassium carbonate | 32.0 g |
| 3-Methyl-4-amino-N-ethyl-N-(β-methanesulfonamidoethyl)-aniline sulfate | 5.5 g |
| Brightening agent (of a diaminostilbene type) | 1.0 g |
| Diethylhydroxylamine | 5.0 g |
| Diethylenetriaminepentaacetic acid | 3.0 g |
| Potassium bromide | 2 mg |
| Sodium 1,2-dihydroxybenzene-3.5-disulfonate | 0.2 g |

Made up to 1 liter in total by the addition of water, and adjusted to pH 10.15 using KOH and $H_2O_4$.

-continued (Color developing replensihing solution)

The 3-methyl-4-amino-N-ethyl-N-(β-methanesulfonamidoethyl)-aniline sulfate is used in an amount of 7.0 g/lit.; and potassium bromide, zero. The pH value is changed to 10.60.

(Bleach-fixing tank solution and replenishing solution)

| | |
|---|---|
| Ammonium ferric ethylenediaminetetraacetate dihydrate | 60 g |
| Ethylenediaminetetraacetic acid | 3 g |
| Ammonium thiosulfate (a 70% solution) | 140 ml |
| Ammonium sulfite (a 40% solution) | 27.5 ml |

Adjusted to pH 5.8 using potassium carbonate or glacial acetic acid, and made up to 1 liter in total by the addition of water.

TABLE 3

| Compounds added | Stabilizing solution No. 3-1 | 3-2 | 3-3 | 3-4 | 3-5 | 3-6 |
|---|---|---|---|---|---|---|
| Cason WT*1) (g/lit.) | 0.2 | 0.2 | 0.2 | 0.2 | 0.2 | 0.2 |
| 1-Hydroxyethylidene-1,1-diphosphonic acid (g/lit.) | — | — | 30 | 30 | 30 | 30 |
| $ZnCl_2$ (aqueous 50% solution) (g/lit.) | — | 20 | 20 | 20 | 20 | 20 |
| $(NH_4)_2SO_4$ (g/lit.) | — | — | — | — | 5.0 | 5.0 |
| Polyvinyl pyrrolidone*2) (g/lit.) | — | — | — | — | — | 0.5 |
| Orthophenylphenol (g/lit.) | 0.1 | 0.1 | 0.1 | 0.1 | 0.1 | 0.1 |
| Brightening agent (4,4'-diaminostilbene derivative) (g/lit.) | — | — | — | — | — | 2.0 |
| $NH_4OH$ (aqueous 25% solution) (g/lit.) | — | — | — | 10 | 10 | 10 |
| pH (adjusted using $H_2SO_4$ and KOH) | 7.5 | 7.5 | 7.5 | 7.5 | 7.5 | 7.5 |
| Remarks | Comparative | | This invention | | | |

*1)Available from Rohm & Hass Co.

TABLE 4

| Stabilizing solution No. | Stabilizing step processing tank Time variation in 1-tank system 10 sec | 20 sec | 30 sec | 45 sec | 60 sec | 90 sec | 2-Tank system (15 sec per tank) | 3-tank system (10 sec per tank) |
|---|---|---|---|---|---|---|---|---|
| 3-1 | 6 | 5 | 4 | 3 | 1 | 1 | 1 | 1 |
| 3-2 | 2 | 2 | 1 | 1 | 1 | 1 | 1 | 1 |
| 3-3 | 1 | 0 | 0 | 0 | 1 | 1 | 1 | 1 |
| 3-4 | 0 | 0 | 0 | 0 | 1 | 1 | 1 | 1 |
| 3-5 | 0 | 0 | 0 | 0 | 1 | 1 | 1 | 1 |
| 3-6 | 0 | 0 | 0 | 0 | 1 | 1 | 1 | 1 |

As will be evident from Tables 3 and 4, it is preferred in this invention to add in the stabilizing solution the metal salt or a chelating agent, or the combination of a chelating agent and the metal salt.

The above experiments were repeated by using each of tripolyphosphoric acid, ethylenediaminetetrakismethylenephosphonic acid, diethylenetriaminepentamethylenephosphonic acid, 2-phosphonobutane-1,2,4-tricarboxylic acid, nitorilotrismethylenephosphonic acid and hydroxyaminodiphosphonylmethane, in place of the chelating agent used in the stabilizing solution No. 3-6. As a result, there were obtained the same results.

$CaCl_2$, $NgSO_4$, $BaCl_2$, $AlCl_2$, $NiSO_4$ and $Sn(SO_4)_2$ were also each used in an amount of 0.02 mol/lit. in place of $ZnCl_2$ used in the stabilizing solution No. 3-6. As a result, there were obtained the same results.

Moreover, bluing tests were estimated for the examples during the processing time of this invention. As a result, no bluing was revealed, provided that bluing was slightly shown in the stabilizing solution No. 3-1. Further, generation of mildew on the color photographic paper after processing was estimated in the same manner as in Example 1. As a result, no generation of mildew was revealed, provided that mildew was slightly shown in the stabilizing solution No. 3-1.

EXAMPLE 8

The estimation for jam trouble was conducted in the same manner as in Example 7, using the stabilizing solution No. 3-3, provided that used as the bleaching agent were each 110 g of ammonium ferric ethylenediaminetetraacetate dihydrate, ammonium ferric diethylenetriaminepentaacetate and ammonium ferric 1,3-propylenediaminetetraacetate and 200 ml of aqueous 70% solution of ammonium thiosulfate. As a result, no troublesome of jam trouble was caused even if the processing time in the stabilizing step was only 10 minutes. Also, bleach-fixing property was tested. As a result, it was found that desilvering property was a little worse in the bleach-fixing solution of Example 7 in an amount of residual silver of about 0.6 mg/100 $m^2$. However, the residual silver amount was reduced to 0.3 to 0.4 mg/100 $m^2$ by employing the composition of the bleach-fixing solution of this example.

EXAMPLE 9

Estimation of mildew and bluing were conducted in the same manner as in Example 1 by varying the concentration of sulfite of the Experiment No. 1-5 of Example 1 as shown in Table 5. The results are also shown in Table 5.

TABLE 5

| | Stabilizing solution | | | | |
|---|---|---|---|---|---|
| Test No. | Ammonium sulfite (mol/lit.) | Processing time (sec) | Salt concentration (ppm) | Generation of mildew | Occurrence of bluing |
| 5-1 | $5 \times 10^{-4}$ | 45 | 10,000 | 0 to 1 | B |
| 5-2 | $1 \times 10^{-3}$ | 45 | 10,000 | 0 | A |
| 5-3 | $5 \times 10^{-3}$ | 45 | 10,000 | 0 | A |
| 5-4 | $1 \times 10^{-2}$ | 45 | 10,000 | 0 | A |
| 5-5 | — | 45 | 10,000 | 0 to 1 | B |

As will be evident from Table 5, the addition of ammonium sulfite to the stabilizing solution, particularly in an amount of $1 \times 10^{-3}$ mol/lit. can be effective against the generation of mildew and bluing. Moreover, white background after processing was also estimated, and it was found that the addition of ammonium sulfite reduced the red reflection density by about 0.01 to 0.02 than that no added, resulting in good white background.

EXAMPLE 10

Estimation of bluing was conducted in the same manner as in Example 1, provided that each times of the color developing, bleach-fixing and stabilizing processing steps in Example 1 were varied as shown in Table 6 and the salt concentration of the stabilizing solution was adjusted to 3,000 ppm in the similar manner as in Example 1.

TABLE 6

| Test No. | Color developing (sec) | Bleach-fixing time (sec) | Stabilizing time (sec) | Bluing |
|---|---|---|---|---|
| 6-1 | 10 | 20 | 20 | A |
| 6-2 | 30 | 20 | 20 | A |
| 6-3 | 50 | 20 | 20 | A |
| 6-4 | 70 | 20 | 20 | B |
| 6-5 | 20 | 10 | 20 | A |
| 6-6 | 20 | 30 | 20 | A |
| 6-7 | 20 | 50 | 20 | A |
| 6-8 | 20 | 70 | 20 | A to B |
| 6-9 | 20 | 20 | 10 | A |
| 6-10 | 20 | 20 | 30 | A |
| 6-11 | 20 | 20 | 50 | B to C |
| 6-12 | 20 | 20 | 70 | C |

As will be evident from Table 6, good result against bluing can be obtained by processing in 45 seconds of stabilizing processing time and 90 seconds of the total processing time of color developing time, bleach-fixing time and stabilizing processing time.

Hereinbelow, the apparatus for treating the light-sensitive material according to this invention will be described by referring drawings of the automatic processing apparatus for photographic papers as a typical example.

In FIG. 1, 1 denotes a fitted portion for installing a magazine that houses photographic paper 2 on which latent images are formed by photographic printing with use of photographic printing machine (not shown in the figure). The installed portion is provided on the side wall of a main body 4.

The photographic paper 2 installed in the fitted portion 1 is put into a nip roll of the inlet of the main body by its end, after processed automatically through a color developing bath 6, a bleach-fixing bath 7 and a stabilizing bath 8, dried in a drying section 10 and taken out from an outlet 11 provided on the upper section of the main body 4. Each processing are not necessarily conducted by use of bath type, but may be conducted by use of spray type, etc.

The photographic paper taken out from the drying section 10 may be, if image quality treatment from luster to matte is necessary, treated by use of a rough surface roller mechanism 12.

Numeral 13 denotes a fixed roller adjoined to the rear face side of the photographic paper 2 and numeral 14 denotes a movable roller adjoined to the front face side of the photographic paper 2. The fixed roller 13 is rotatably pivoted by axially fixing member on its both ends. As the movable roller 14, a rough roller is employed. In the case where a matted surface is prepared in response to necessity, a motor is turn on by turning on a turning switch to move the roller so that a cam can move to the position indicated in the figure, and then the motor is stopped by the actuation of a microswitch for detecting the cam position. By the accumulated power of the pulling spring in accompanying with the actuation of the cam, the movable roller 14 is brought into contact with (or adjoined to) the fixed roller 13.

The photographic paper, treated in image quality as occasion arises, passes through an accumulator section 22 for buffering the change of processing speed, is stopped at once at a cutter section 23, and, after a cutter mark detecting section 24 detects a cutter mark, is cut by a cutter. As the cutter 25, for example, direct move-type cutting blade is employed. However, not being limited to the cutter, any other cutter may be employed.

The photographic papers cut in given size are collected in a receptacle pan 26. The receiving portion may be the upper portion of the main body 4 as shown in the figure or may be other portion.

In the case where the processing steps after the drying section 10 are all provided on the main body 4, it is preferred to pivotally mount a terminal end of the ceiling on the portions having the above all processing steps by hinge and the like so that the ceiling can be opened, in order to undergo maintenance.

In this figure, numeral 27 denotes water-supplying tank (preferably exchangeable with no piping), 28, a waste liquid tank and 29, control box.

In this figure, the processing time of the color developing processing step refers to the time from when the light-sensitive material passes the point a to when the same portion of the light-sensitive material reaches to the point c through the point b. Also, The processing time of the bleach-fixing processing refers to the time from when the light-sensitive material passes the point c to when the same portion of the light-sensitive material reaches to the point e through the point d. Similarly, the processing time of the stabilizing processing refers to the time from when the light-sensitive material passes the point e to when the same portion of the light-sensitive material reaches to the point f.

Figure 2:
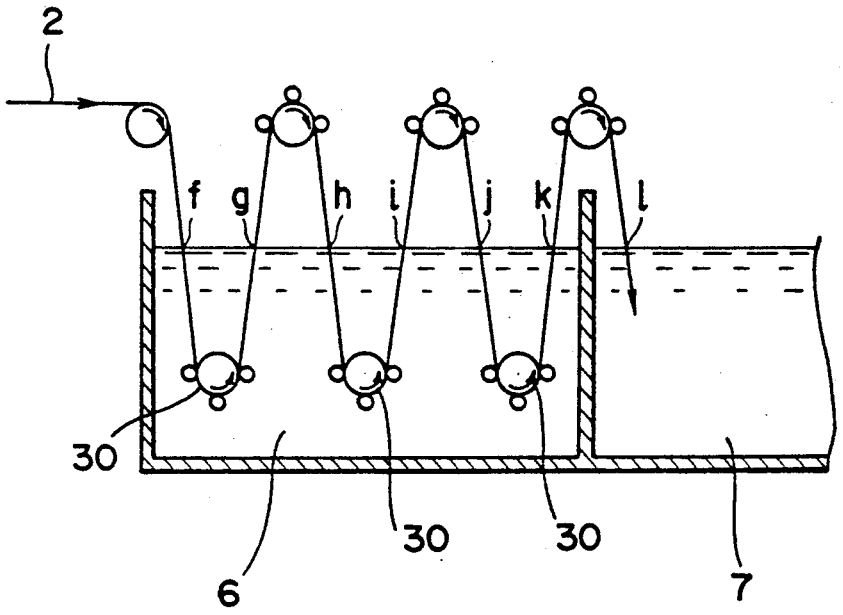
FIGS. 2 to 7 show other embodiments of the automatic processing apparatus according to this invention.

In each processing bath (for example, the color developing bath 6, bleach-fixing bath 7 and/or stabilizing bath 8), as shown-in FIG. 2, the light-sensitive material to be processed may be turned twice or more by means of a lower portion turn roller 30 to interpose a step that the light-sensitive material is brought into contact with air once or more. In this instance, the processing time of the processing step refers to the time from when the light-sensitive material passes the point f to when the same portion of the light-sensitive material reaches to the point.

Other than the structure of FIG. 2, the processing time can be calculated similarly as in the example shown in FIG. 2, for example, in the case where continuous processing is conducted by use of independent two or more color developing baths, or the color developing process, bleach-fixing process and/or stabilizing process are continuously conducted by use of two or more color developing baths in which the flowing of the liquor is carried out by the regular-current system or the counter-current system.

In the instance where the process by use of the processing liquid having a bleaching ability is carried out separately in twice or more, for example, (1) process by use of the bleach-fixing solution→process by use of the bleach-fixing solution, (2) process by use of the bleaching solution→process by use of the bleach-fixing solution, and (3) process by use of the bleach-fixing solution→process by use of the fixing solution, the processing time having the bleaching ability is calculated similarly as in the example shown in the above FIG. 2. The replenishing solution may be replenished by any of the regular-current system and the counter-current system.

The structure of the automatic processing apparatus of this invention is by no means limited to the embodiments shown in FIGS. 1 and 2, and may be made in accordance with any conventional method.

The automatic processing machine of this invention may, for example, have a construction as described in Japanese Unexamined Patent Publication No. 1147/1983 in which provided side by side are two or more of a pair of transporting rollers 31A and 31B, a pair of blades 32A and 32B that are provided on the upper and lower portions of each of the rollers 31A and 31B for maintaining watertightness, a color developing bath 6 and a bath 7 having a bleaching ability, while interposing a gas chamber 33 as described in Japanese Unexamined Patent Publication No. 9350/1987 in which an air or nitrogen gas is charged.

Figure 3:
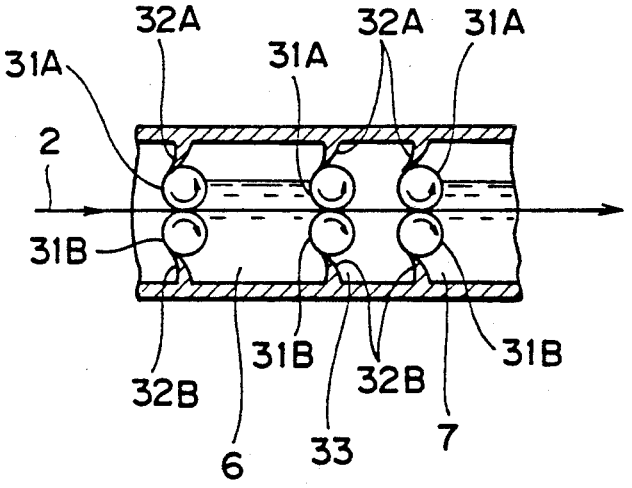
Figure 4:
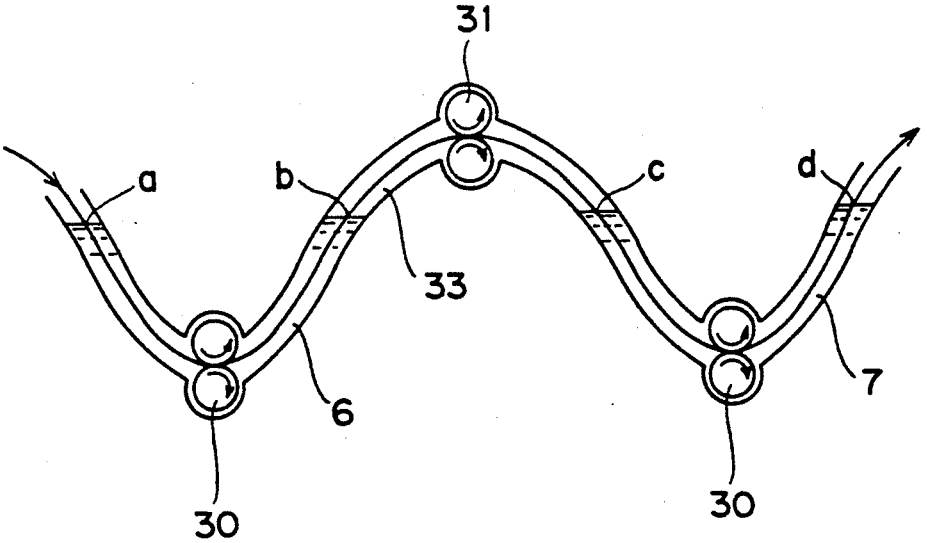
Figure 5:
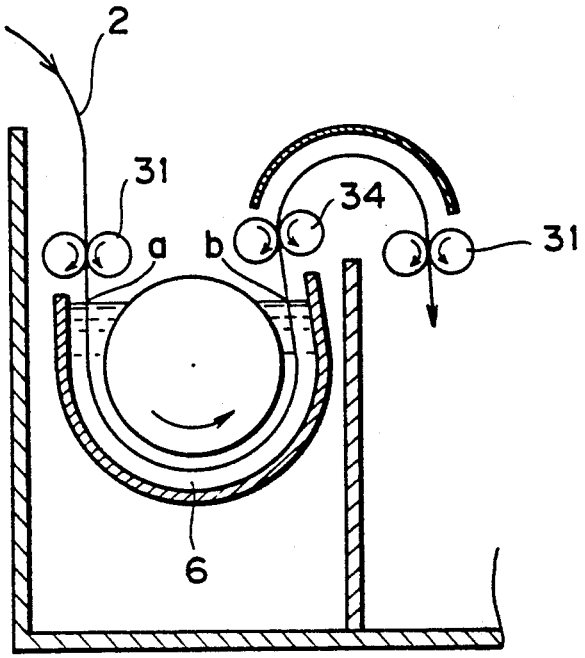

The automatic processing machine of this invention may also have a construction as shown in FIGS. 3 to 4, which has a slit-like processing bath provided with at the appropriate portions of the passage, a transporting roller 31 and a squeeze roller 32 or a transporting roller which also serves as squeezing ability 34 (reference may be made by Japanese Unexamined Patent Publication Nos. 77851/1986 and 167362/1988 and U.S. Pat. No. 3,769,897).

Figure 6:
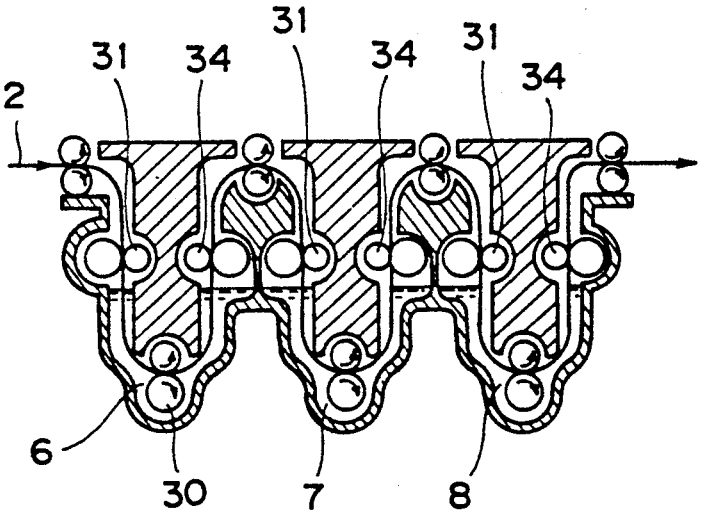
Figure 7:
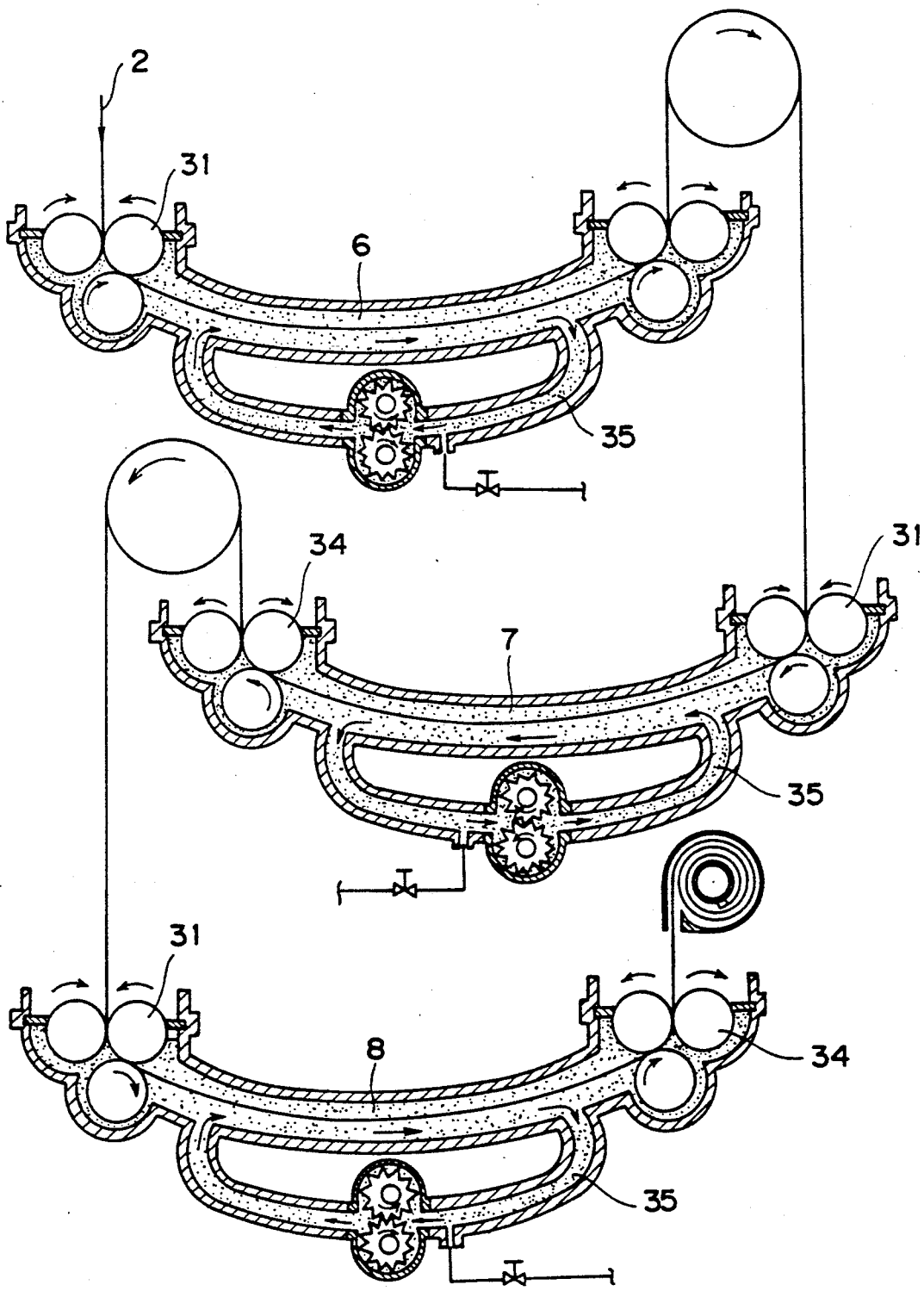

Another example of the automatic processing machine of this invention may have a construction as shown in FIG. 6 in which provided multi-stepwise are a color developing bath 6, a bleach-fixing bath 7 and a stabilizing bath 8 which have a liquid cycling system 35, respectively (reference may be made by Japanese Patent Application No. 283045/1988).

Further, it is needless to say that this invention may be applied to any of the automatic processing machine having a slit-like processing bath provided with a transporting roller on a processing bath to cover the bath as described in U.S. Pat. No. 3,336,853; the automatic processing machine that removes a solid substance adhered to a squeeze roller by applying a liquid thereto as described in U.S. Pat. No. 4,327,456; and the automatic processing machine having a construction which is provided with a transporting roller of taper-like shape to an inlet and outlet of a processing bath to make the transportation of a light-sensitive material paper to be straight as described in U.S. Pat. No. 4,326,791.

We claim:

1. A method of processing a light-sensitive silver halide color photographic material subjected to imagewise exposure, substantially through a color developing step, a bleach-fixing step and a washing-substitutive stabilizing step in this order, wherein at least one layer of said light-sensitive silver halide color photographic material comprises a silver halide containing not less than 80 mol % of silver chloride and a nitrogen containing heterocyclic mercapto compound, said washing-substitutive stabilizing step is carried out in a processing time of not more than 45 seconds, and a washing-substitutive stabilizing solution used in said washing-substitutive stabilizing step has a salt concentration of at least 1,000 ppm.

2. The method of processing a light-sensitive silver halide color photographic material according to claim 1, wherein the light-sensitive silver halide color photographic material comprises a silver halide containing not less than 90 mol % of silver chloride.

3. The method of processing a light-sensitive silver halide color photographic material according to claim 1, wherein the washing-substitutive stabilizing step is carried out in a processing time of 3 to 35 seconds.

4. The method of processing a light-sensitive silver halide color photographic material according to claim 1, wherein the washing-substitutive stabilizing solution has a salt concentration of 2,000 to 50,000 ppm.

5. The method of processing a light-sensitive silver halide color photographic material according to claim 1, wherein the washing-substitutive stabilizing solution contains at least one metal salt selected from the group consisting of Ca, Mg, Ba, Al, Zn, Ni, Bi, Sn and Zr.

6. The method of processing a light-sensitive silver halide color photographic material according to claim 5, wherein the at least one metal salt is contained in an amount of $1\times10^{-4}$ to $1\times10^{-1}$ mol per one liter of the washing-substitutive stabilizing solution.

7. The method of processing a light-sensitive silver halide color photographic material according to claim 1, wherein the washing-substitutive stabilizing solution contains sulfite in an amount of at least $1.0\times10^{-3}$ mol per one liter of the washing-substitutive stabilizing solution.

8. The method of processing a light-sensitive silver halide color photographic material according to claim 7, wherein the washing-substitutive stabilizing solution contains sulfite in an amount of $5\times10^{-3}$ to $1.0\times10^{-1}$ mol per one liter of the washing-substitutive stabilizing solution.

9. The method of processing a light-sensitive silver halide color photographic material according to claim 1, wherein the bleach-fixing step include a processing by using a bleach-fixing solution which contains a ferric complex salt in an amount of at least 0.2 mol/liter per one liter of the bleach-fixing solution and a fixing agent for silver halide in an amount of at least 0.7 mol/liter per one liter of the bleach-fixing solution.

10. The method of processing a light-sensitive silver halide color photographic material according to claim 1, wherein the washing-substitutive stabilizing step comprises one or two washing-substitutive stabilizing baths.

11. The method of processing a light-sensitive silver halide color photographic material according to claim 1, wherein the total processing time of the color developing step, bleach-fixing step and washing-substitutive stabilizing step is not more than 90 seconds.

12. The method of processing a light-sensitive silver halide color photographic material according to claim 1, wherein the light-sensitive silver halide color photographic material comprises a silver halide containing not less than 90 mol % of silver halide, said washing-substitutive stabilizing step is carried out in a processing time of not more than 3–35 seconds, and a washing-substitutive stabilizing solution used in said washing-substitutive stabilizing step has a salt concentration of at least 2,000–50,000 ppm.

13. The method of processing a light-sensitive silver halide color material according to claim 12, wherein said stabilizing step is carried out in a processing time of 5–25 seconds.

14. The method of processing a light-sensitive silver halide color photographic material according to claim 13, wherein the washing-substantive stabilizing solution contains at least one metal salt selected from the group consisting of Ca, Mg, Ba, Al, Sn, Ni, Bi, Sn and Zr.

15. The method of processing a light-sensitive silver halide color photographic material according to claim 14, wherein the washing-substitutive stabilizing solution has a salt concentration of 3,000 to 30,000 ppm.

16. The method of processing a light-sensitive silver halide color photographic material according to claim 12, wherein the washing-substitutive stabilizing solution has a salt concentration of at least 10,000 ppm.

17. The method of processing a light-sensitive silver halide color photographic material according to claim 12, wherein the total processing time of the color developing step, bleach-fixing step and washing-substitutive stabilizing step is not more than 90 seconds.

18. The method of processing a light-sensitive silver halide color photographic material according to claim 12, wherein the light-sensitive silver halide color photographic material comprises a silver halide containing not less than 95 mol % of silver chloride.

19. The method of processing a light-sensitive silver halide color photographic material according to claim 12, wherein the light-sensitive silver halide color photographic material comprises a silver halide containing not less than 99 mol % of silver chloride.

20. The method of processing a light sensitive silver halide color photographic material according to claim 1, wherein the photographic material further contains a nitrogen-containing heterocyclic mercapto compound selected from the group consisting of compounds (I'-1) through (I'-86) as follows:

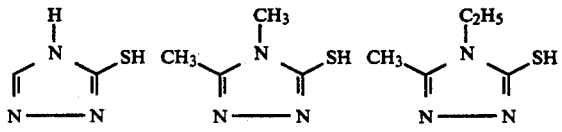
I'-1

I'-2

I'-3

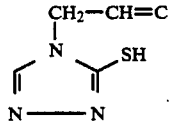
I'-4

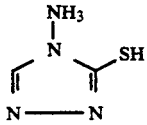
I'-5

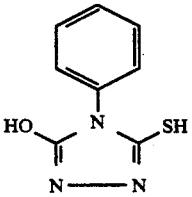
I'-6

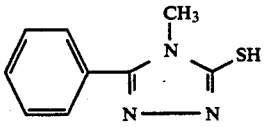
I'-7

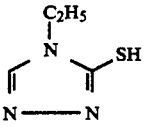
I'-8

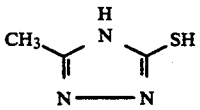
I'-9

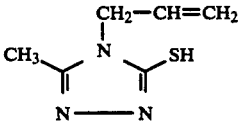
I'-10

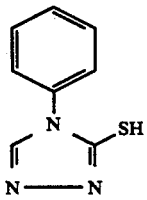
I'-11

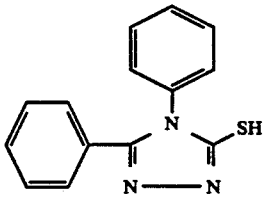
I'-12

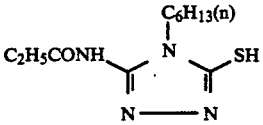
I'-13

-continued
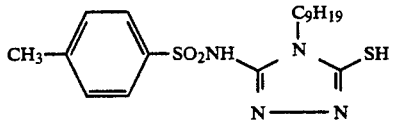
I'-14
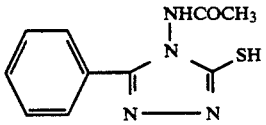
I'-15
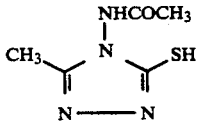
I'-16
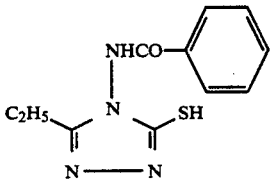
I'-17
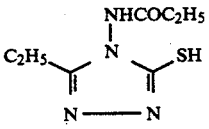
I'-18
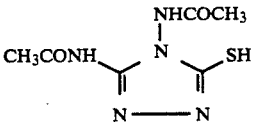
I'-19
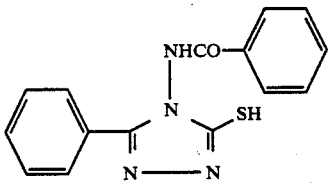
I'-20
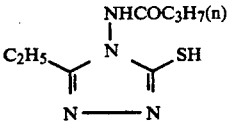
I'-21
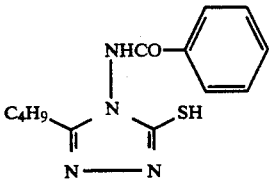
I'-22
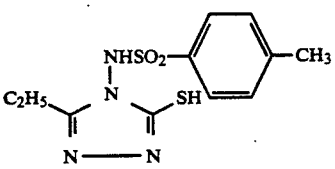
I'-23
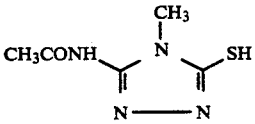
I'-24
-continued
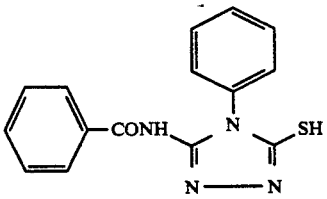
I'-25
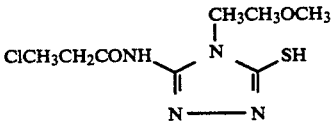
I'-26
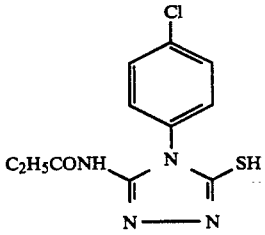
I'-27
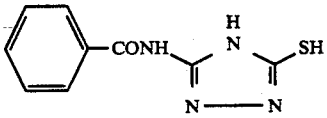
I'-28
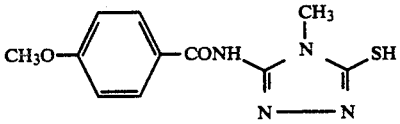
I'-29
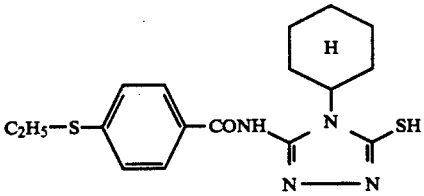
I'-30
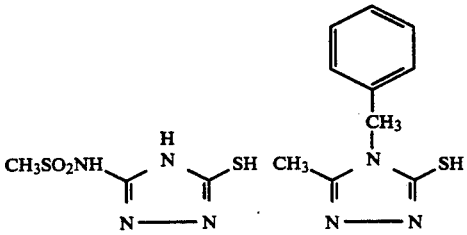
I'-31
I'-32

-continued
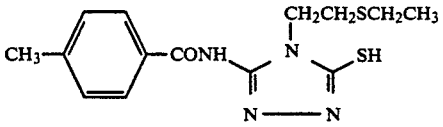
I'-33
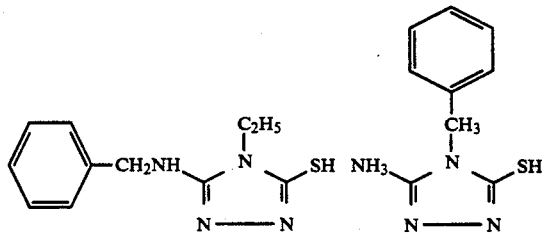
I'-34 I'-35
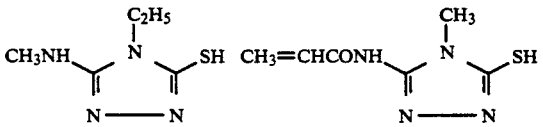
I'-36 I'-37
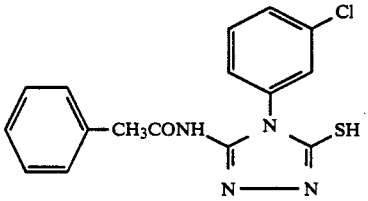
I'-38
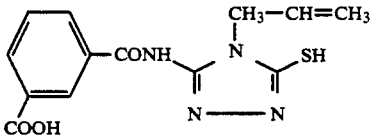
I'-39
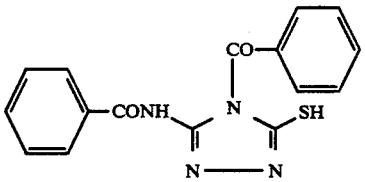
I'-40
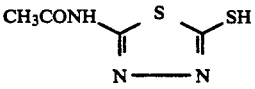
I'-41
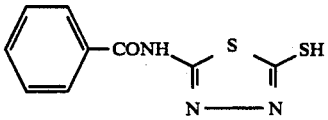
I'-42
-continued
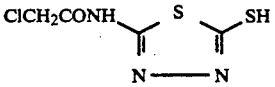
I'-43
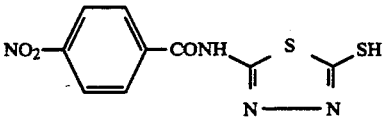
I'-44
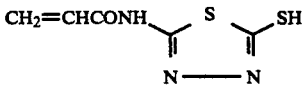
I'-45
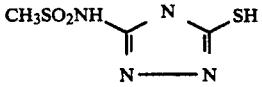
I'-46
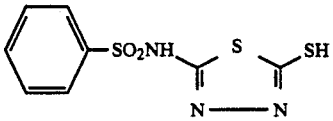
I'-47
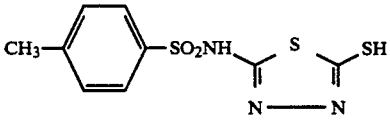
I'-48
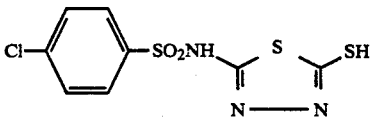
I'-49
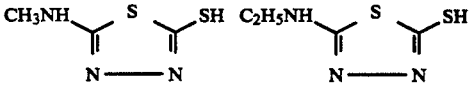
I'-50 I'-51
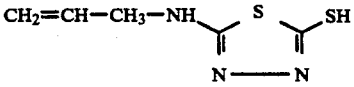
I'-52
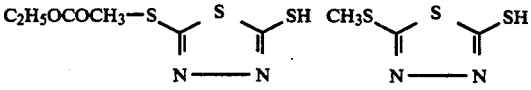
I'-53 I'-54

-continued
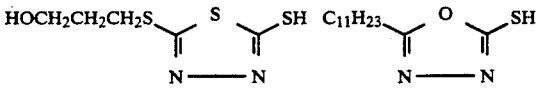
I'-55
I'-56
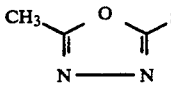
I'-57
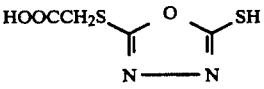
I'-58
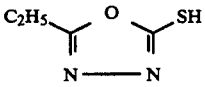
I'-59
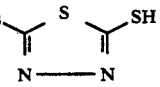
I'-60
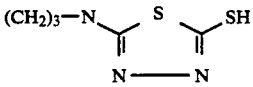
I'-61
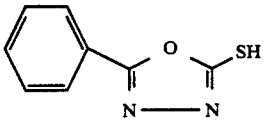
I'-62
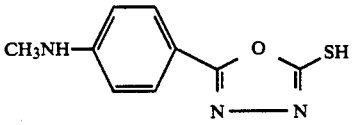
I'-63
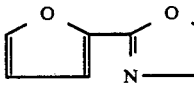
I'-64
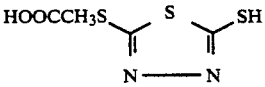
I'-65
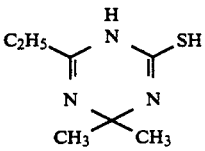
I'-66
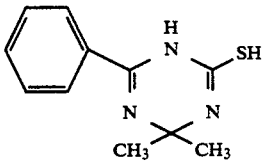
I'-67
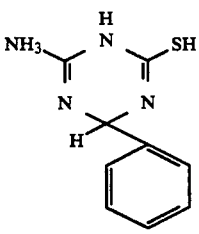
I'-68
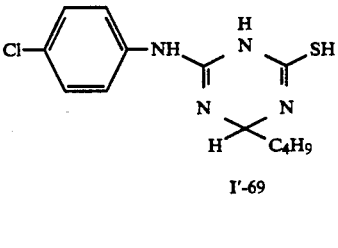
I'-69
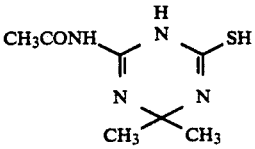
I'-70
-continued
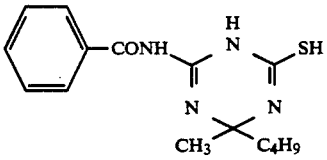
I'-71
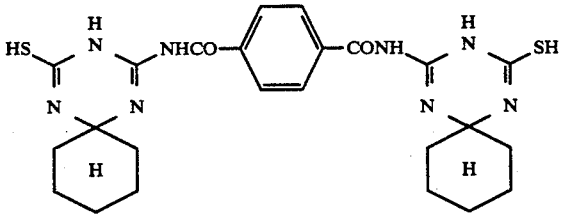
I'-72
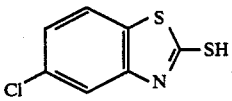
I'-73
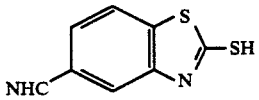
I'-74
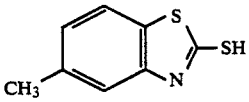
I'-75
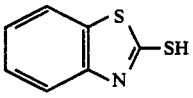
I'-76
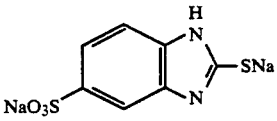
I'-77
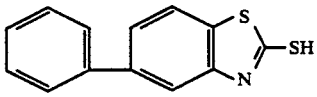
I'-78
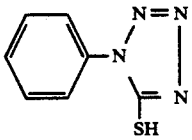
I'-79
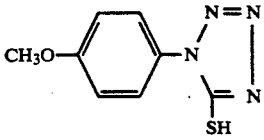
I'-80
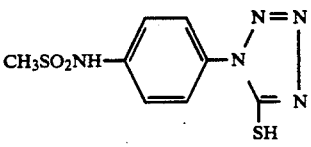
I'-81

-continued

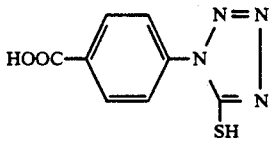

I'-82

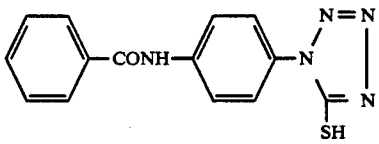

I'-83

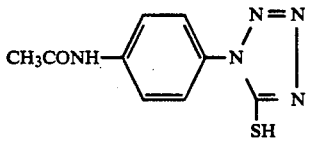

I'-84

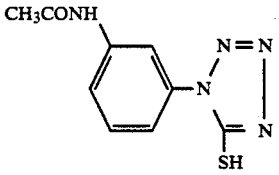

I'-85

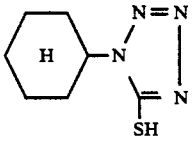

I'-86

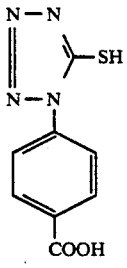

I'-87

21. The method of processing a light-sensitive silver halide color photographic material according to claim 20 wherein the photographic material further contains a cyan coupler represented by the formula (C-I) or (C-II) as defined below:

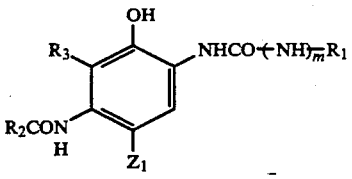

(C-I)

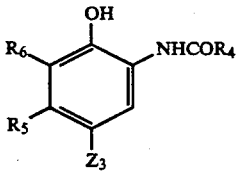

(C-II)

wherein $R_1$, $R_2$ and $R_4$ represents respectively optionally substituted fatty group, aryl group or heterocyclic group, $R_3$ and $R_6$ represents respectively hydrogen, halogen and optionally substituted fatty group, aryl group or acylamino group, $R_2$ and $R_3$ may make a ring, $R_5$ represents an optionally substituted alkyl, $Z_1$ and $Z_2$ represents respectively hydrogen or a group able to split off by the reaction with oxidized color developing agent, n means 0 or 1.

22. In a washing-substitutive stabilizing solution for a light-sensitive silver halide color photographic material, used in a washing-substitutive stabilizing step carried out substantially after a color developing step and a bleach-fixing step, wherein a photographic material having at least one layer a silver halide containing not less than 80 mol % of silver chloride, and a nitrogen containing heterocyclic mercapto compound, and wherein said washing-substitutive stabilizing step is carried out in a processing time of not more than 45 seconds, comprising said washing-substitutive stabilizing solution having a salt concentration of at least 1,000 ppm.

* * * * *